US008620170B2

(12) United States Patent
Takenaka

(10) Patent No.: US 8,620,170 B2
(45) Date of Patent: Dec. 31, 2013

(54) IMAGE FORMING APPARATUS

(75) Inventor: Tomohide Takenaka, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 364 days.

(21) Appl. No.: 12/929,584

(22) Filed: Feb. 2, 2011

(65) Prior Publication Data

US 2011/0206394 A1 Aug. 25, 2011

(30) Foreign Application Priority Data

Feb. 19, 2010 (JP) ..... 2010-034573

(51) Int. Cl.
*G03G 15/00* (2006.01)

(52) U.S. Cl.
USPC ..... 399/46

(58) Field of Classification Search
USPC ..... 399/46, 47, 48, 49, 50, 55
See application file for complete search history.

(56) References Cited

U.S. PATENT DOCUMENTS

2004/0071477 A1* 4/2004 Do ..... 399/53
2008/0187338 A1* 8/2008 Yamamoto et al. ..... 399/56

FOREIGN PATENT DOCUMENTS

JP 2008-076576 4/2008
JP 2010-191364 9/2010

* cited by examiner

*Primary Examiner* — Walter L Lindsay, Jr.
*Assistant Examiner* — Barnabas Fekete
(74) *Attorney, Agent, or Firm* — Harness, Dickey & Pierce P.L.C.

(57) ABSTRACT

In a RAM are stored a first deflection information table representing the relationship between the rotation amount and the deflection amount of a photosensitive element, a second deflection information table representing the relationship between the rotation amount and the deflection amount of a developing sleeve, a writing sensitivity information table representing the relationship between the rotation amount of the photosensitive element and latent image writing sensitivity, and an image forming condition information table representing the relationship between the rotation amount and laser power. An information input unit is provided to input the respective tables. During a print job, laser power is changed on the basis of the image forming condition information table, and laser power which causes deviation in an opposing direction is calculated on the basis of information input in a standby state to update the image forming condition information table.

18 Claims, 12 Drawing Sheets

| MEASUREMENT No. | PHOTOSENSITIVE ELEMENT DEFLECTION [μm] |
|---|---|
| 1 | 0 |
| 2 | 15 |
| ⋮ | ⋮ |
| n2 | −10 |

660

661

| MEASUREMENT No. | DEVELOPING SLEEVE DEFLECTION [μm] | |
|---|---|---|
| 1 | 0 | 650 |
| 2 | −10 | |
| . | . | |
| n1 | 20 | 651 |
| 1 | 0 | |
| 2 | −10 | |
| | . | |
| n1 | 20 | |
| 1 | 0 | |
| 2 | −10 | |
| . | . | |
| n1 | 20 | |
| 1 | 0 | |
| 2 | −10 | |
| . | . | |
| n1 | 20 | |

DEFLECTION INFORMATION NUMBER OF ROWS: n2

| MEASUREMENT No. | DEVELOPING GAP [μm] |
|---|---|
| 1 | 350 (d1) |
| 2 | 345 |
| ⋮ | ⋮ |
| k | dk |
| ⋮ | ⋮ |
| n2 | 340 |

670

| TIME t [s] | CORRECTED LD POWER [μW] |
|---|---|
| 0 | |
| t | |
| ⋮ | ⋮ |
| (n2-1)×t | |

FIG. 18

| MEASUREMENT No. | INCLINATION | SEGMENT |
|---|---|---|
| 1 | $a_1$ | $b_1$ |
| 2 | $a_2$ | $b_2$ |
| . | . | . |
| . | . | . |
| . | . | . |
| K | $a_k$ | $b_k$ |
| . | . | . |
| . | . | . |
| . | . | . |
| n2 | $a_{n2}$ | $b_{n2}$ |

IMAGE FORMING APPARATUS

CROSS-REFERENCE TO RELATED APPLICATIONS

The present application claims priority to and incorporates by reference the entire contents of Japanese Patent Application No. 2010-034573 filed in Japan on Feb. 19, 2010.

BACKGROUND OF THE INVENTION

1. Field of the Invention

The present invention relates to an image forming apparatus which develops an electrostatic latent image on a latent image carrier with a developer on a developer carrier in a developing gap in which the latent image carrier such as a photosensitive element, and a developer carrier such as a developing sleeve face each other with a predetermined gap therebetween.

2. Description of the Related Art

An image forming apparatus of this type is described in Japanese Patent Application Laid-open No. 2008-76576. In this image forming apparatus, a predetermined developing gap is formed between a drum-shaped photosensitive element serving as a latent image carrier and a developing sleeve serving as a developer carrier. In the developing gap, a developing electric field is formed between an electrostatic latent image of the photosensitive element and the developing sleeve. A developing bias is applied to the developing sleeve. The developing electric field is formed by a developing potential which is the potential difference between the electrostatic latent image of the photosensitive element and the developing sleeve. Toner in a developer, which contains toner and a magnetic carrier and is carried on the surface of the developing sleeve, is electrostatically transferred from the surface of the magnetic carrier to the electrostatic latent image of the photosensitive element by the action of the above-described developing electric field. Thus, the electrostatic latent image is developed and becomes a toner image.

In the drum-shaped photosensitive element and the cylindrical developing sleeve, fine eccentricity inevitably occurs due to the limitation on component manufacturing accuracy. For this reason, in the developing gap, deflection occurs in the direction normal to the rotating photosensitive element surface or the rotating sleeve surface. In accordance with the deflection, if the size of the developing gap varies finely, the developing electric field intensity varies finely between the electrostatic latent image on the photosensitive element and the developing sleeve. For this reason, irregularity in image density occurs in an image due to the variation. There are errors in a circumferential direction of latent image writing sensitivity in the circumferential surface of the drum-shaped photosensitive element, and the developing electric field intensity varies due to the errors in the circumferential direction, which also causes irregularity in image density.

In an image forming apparatus described in Japanese Patent Application Laid-open No. 2008-76576, irregularity in image density attributable to the deflection of the developing sleeve is reduced in the following manner. That is, a home position sensor is provided in the vicinity of the developing sleeve to detect that the developing sleeve is at a home position which is a predetermined rotation pose. Then, a test image is formed on the photosensitive element at a predetermined timing, and the image density of the test image is detected by an image density sensor. Next, irregularity in image density which occurs in a sleeve rotation period is analyzed on the basis of the detection result of the image density of the test image and the detection result of the above-described home position. A motor driving control pattern for causing the following variation in the rotation speed is constructed on the basis of the analysis result. That is, with regard to variation in the rotation speed, within one rotation period of the developing sleeve, at a timing at which insufficiency in image density occurs, the sleeve rotation speed is increased (the toner supply amount is increased) to increase image density. Meanwhile, at a timing at which image density is excessive, the sleeve rotation speed is reduced (the toner supply amount is decreased) to lower image density. Thereafter, during a print job, variation in the rotation speed is intentionally caused in the developing sleeve to reduce irregularity in image density attributable to the deflection of the developing sleeve.

However, it has been impossible to reduce irregularity in image density attributable to the deflection of the photosensitive element, or irregularity in image density attributable to errors in the circumferential direction of latent image writing sensitivity of the photosensitive element. A test image is formed so as to detect irregularity in image density which actually occurs, extending the waiting time of the user.

Accordingly, the inventors of the present invention have been developing the following novel image forming apparatus. That is, the driving speed of each of the photosensitive element and the developing sleeve is set such that the developing sleeve rotates integer times each time the photosensitive element rotates integer times. When a method is used in which the photosensitive element and the developing sleeve are driven by the same motor, a home position sensor is provided to detect that one of the photosensitive element and the developing sleeve is at a home position. When a method is used in which the photosensitive element and the developing sleeve are driven by separate motors, a home position sensor is provided for each of the photosensitive element and the developing sleeve, and during a print job, each of the motors is started such that a home position detection timing is synchronized. When this happens, variation in the developing gap attributable to the deflection of the photosensitive element or the developing sleeve occurs in the same period as a home position period which is the period of detecting the home position. The period of variation in the developing electric field intensity due to the variation in the developing gap and the cyclic errors of latent image writing sensitivity of the photosensitive element is the same as the above-described home position period. With regard to the variation in the developing electric field intensity, if a variation pattern having a phase opposite to such variation is provided in the image forming condition such as the developing bias or the latent image writing intensity, such variation can be eliminated. Accordingly, the control pattern of the image forming condition (for example, the variation pattern of the latent image writing intensity) for generating the variation pattern of the image forming condition is examined in advance and stored in a data storage unit. Then, during a print job, a power supply, a laser diode, or the like is driven on the basis of the detection result of the home position sensor and the control pattern of the image forming condition. Thus, the developing electric field intensity may be substantially constant, regardless of the variation in the developing gap or errors of latent image writing sensitivity; and then not only irregularity in image density due to the deflection of the developing sleeve may be reduced, but also irregularity in image density due to the deflection of the photosensitive element or errors of the latent image writing sensitivity may be reduced. The period of the photosensitive element or the like may be obtained on the basis of the detection result of a rotation amount by a hall sensor using a hall element, a rotary encoder, or the like, instead of the detection result of the home position sensor. While the motor is stopped, when a configuration is provided in which the rotation of the motor shaft is inhibited by external force, the period of the photosensitive element or the like may be obtained on the basis of the motor driving time.

However, in an image forming apparatus having such a configuration under development, when the photosensitive element or the developing sleeve comes to the end of its life and thus replaced, the variation pattern of the developing gap or the pattern of errors in the circumferential direction of the latent image writing sensitivity is changed. As a result, the control pattern of the image forming condition stored in advance becomes not compatible with a new variation pattern of the developing gap or a new pattern of errors in the circumferential direction of latent image writing sensitivity. If this happens, it is impossible to appropriately reduce irregularity in image density.

SUMMARY OF THE INVENTION

It is an object of the present invention to at least partially solve the problems in the conventional technology.

According to an aspect of the present invention, an image forming apparatus is configured to form an image using an image forming unit and a control unit, the image forming apparatus includes: the image forming unit including a latent image carrier carrying a latent image on the rotating surface thereof, a latent image writing unit writing an electrostatic latent image on the surface of the latent image carrier, and a developer carrier developing the electrostatic latent image with a developer carried on the rotating surface thereof while forming a developing electric field between the electrostatic latent image on the latent image carrier and the surface of the developer carrier in a developing area where the latent image carrier and the surface of the developer carrier are opposite each other with a predetermined developing gap therebetween; the control unit performing processing of controlling driving of the image forming unit or processing of varying an image forming condition of the image forming unit; an information storage unit which stores first deflection information, second deflection information, writing sensitivity information, and image forming condition information, the first deflection information representing the relationship between the surface movement amount of the latent image carrier and the deflection amount in a direction of variation in the developing gap, at a place within the developing gap from the circumferential surface of the latent image carrier, the second deflection information representing the relationship between the surface movement amount of the developer carrier and the deflection amount in a direction of variation in the developing gap at a place within the developing gap from the circumferential surface of the developer carrier, the writing sensitivity information representing the relationship between the surface movement amount of the latent image carrier and latent image writing sensitivity, and the image forming condition information representing the relationship between the surface movement amount of at least one of the latent image carrier and the developer carrier and an image forming condition for generating deviation in an opposing direction to deviation from a reference value attributable to the deflection of the latent image carrier, the deflection of the developer carrier, and errors in the circumferential direction of latent image writing sensitivity of the latent image carrier in a developing electric field intensity; and an information input unit which inputs the first deflection information, the second deflection information, and the writing sensitivity information, and the control unit is configured such that, during an image forming operation, processing is performed for changing the image forming condition to a value based on the surface movement amount of one of the latent image carrier and the developer carrier on the basis of the image forming condition information; and when the image forming operation is not carried out, if at least one of the first deflection information, the second deflection information, and the writing sensitivity information is input by the information input unit, processing is performed for calculating the image forming condition for generating the deviation in the opposing direction on the basis of the input information to update the image forming condition information.

According to another aspect of the present invention, an image forming apparatus for forming an image using an image forming unit and a control unit, the image forming apparatus includes: the image forming unit including a latent image carrier carrying a latent image on the rotating surface thereof, a latent image writing unit writing an electrostatic latent image on the surface of the latent image carrier, and a developer carrier developing the electrostatic latent image with a developer carried on the rotating surface thereof while forming a developing electric field between the electrostatic latent image on the latent image carrier and the surface of the developer carrier in a developing area where the latent image carrier and the surface of the developer carrier are opposite each other with a predetermined developing gap therebetween; the control unit performing processing of controlling driving of the image forming unit or processing of varying an image forming condition of the image forming unit; an information storage unit which stores first deflection information, second deflection information, writing sensitivity information, and image forming condition information, the first deflection information representing the relationship between the surface movement amount of the latent image carrier and the deflection amount in a direction of variation in the developing gap, at a place within the developing gap from the circumferential surface of the latent image carrier, the second deflection information representing the relationship between the surface movement amount of the developer carrier and the deflection amount in a direction of variation in the developing gap at a place within the developing gap from the circumferential surface of the developer carrier, the writing sensitivity information representing the relationship between the surface movement amount of the latent image carrier and latent image writing sensitivity, and the image forming condition information representing the relationship between the surface movement amount of at least one of the latent image carrier and the developer carrier and an image forming condition for generating deviation in an opposing direction to deviation from a reference value attributable to the deflection of the latent image carrier, the deflection of the developer carrier, and errors in the circumferential direction of latent image writing sensitivity of the latent image carrier in a developing electric field intensity; an information input unit which inputs the first deflection information and the second deflection information; and a surface potential detection unit which detects the surface potential of the latent image carrier, and the control unit is configured such that, during an image forming operation, processing is performed for changing the image forming condition to a value based on the surface movement amount of one of the latent image carrier and the developer carrier on the basis of the image forming condition information; and when the image forming operation is not carried out, if at least one of the first deflection information and the second deflection information is input by the information input unit, processing is performed for calculating the image forming condition for generating the deflection in the opposing direction on the input information to update the image forming condition information; and if the first deflection information is input by the information input unit, processing is performed for forming an electrostatic latent image at each latent image writing intensity of the stepwise varying latent image writing intensities, obtaining the relationship between the potential of the electrostatic latent image and the latent image writing intensity on the basis of the sequential detection result of the potential of the electrostatic latent image by the surface potential detection unit at each of a plurality of places in the circumferential direction of the latent image carrier, and constructing the writing sensitivity information on the basis of the relationship.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 18 is an explanatory view depicting an example of a writing sensitivity information table.

DETAILED DESCRIPTION OF THE PREFERRED EMBODIMENTS

Hereinafter, description will be provided as to an embodiment of a tandem-type full-color electrophotographic copying machine (hereinafter, simply referred to as "copying machine") having a plurality of photosensitive elements as an image forming apparatus to which the invention is applied.

First, the basic configuration of a copying machine of the present embodiment will be described.

Figure 2:
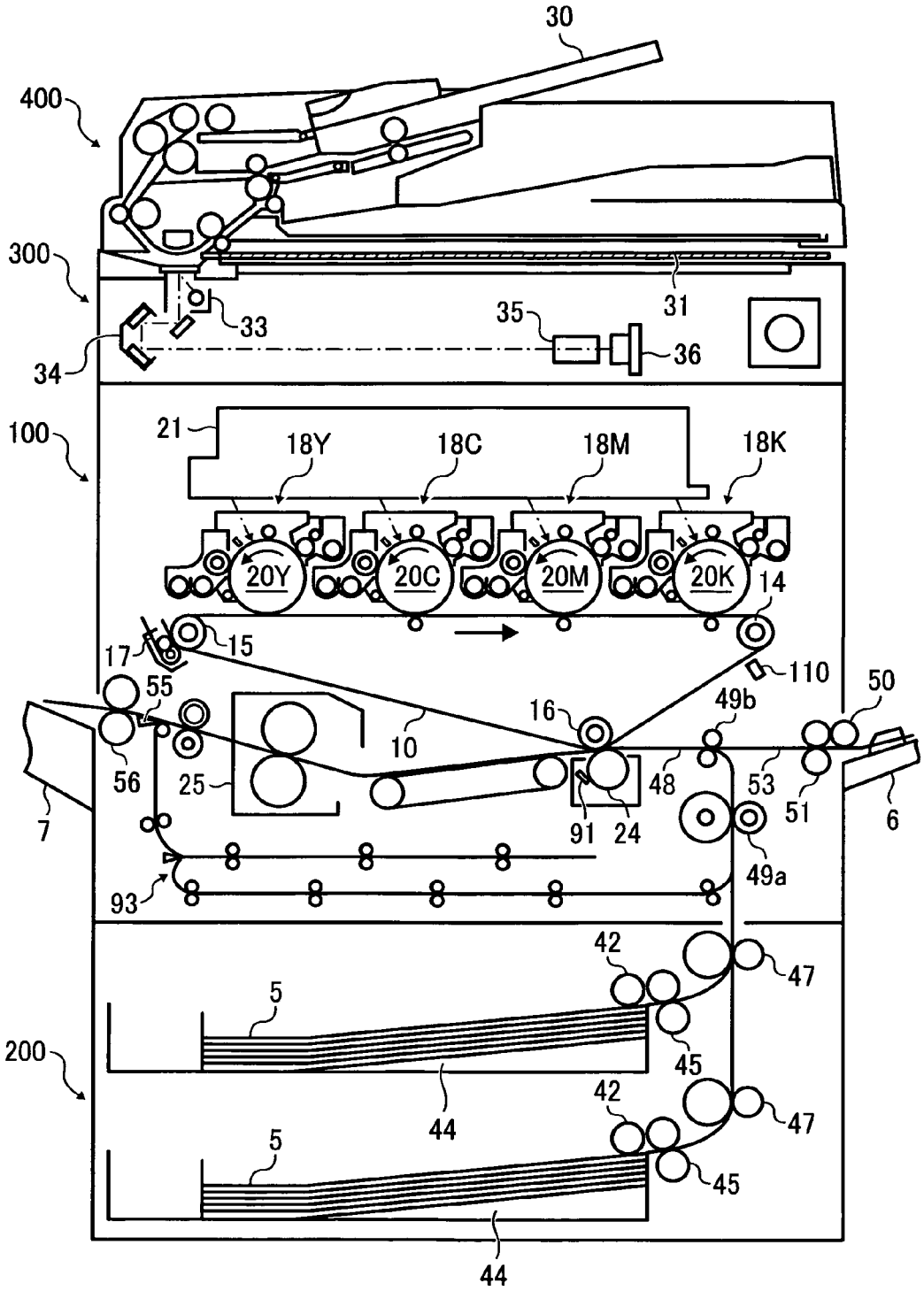
FIG. 2 is a schematic configuration diagram depicting the schematic configuration of the copying machine.

FIG. 2 is a schematic configuration diagram depicting the schematic configuration of a copying machine of this embodiment.

Referring to FIG. 2, the copying machine includes: a print section 100 which performs image formation; a feeding device 200, on which the print section 100 is mounted, and which feeds a transfer sheet 5 serving as a recording sheet to the print section 100; a scanner 300 which is attached onto the print section 100 to read a document image; and an automatic document feeder (ADF) 400 which is attached to the upper part of the scanner 300. The print section 100 is provided with a bypass tray 6 which feeds the transfer sheet 5 manually and a discharge tray 7 to which the transfer sheet 5 on which an image is formed is discharged.

Figure 3:
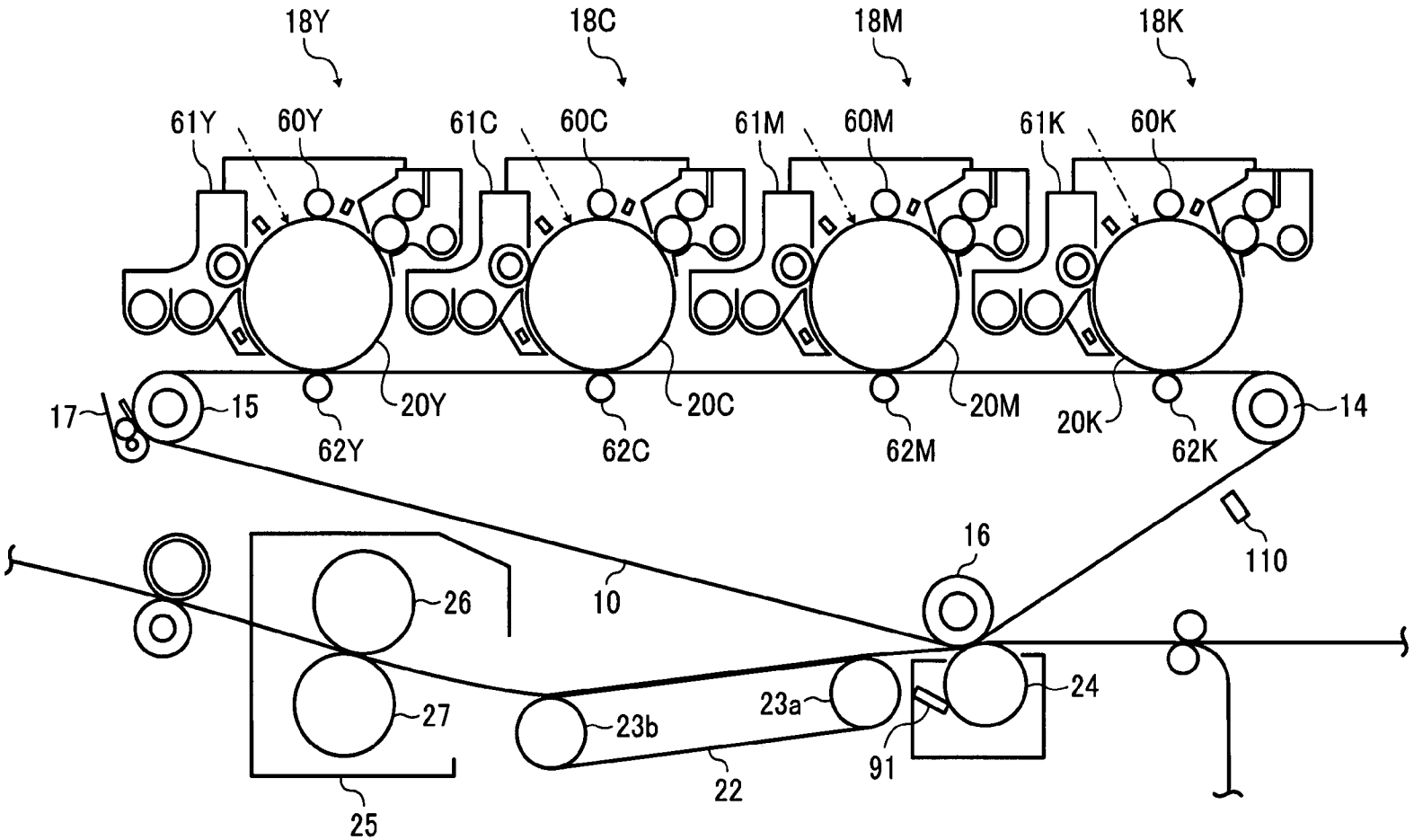
FIG. 3 is an enlarged configuration diagram depicting an intermediate transfer unit and a peripheral configuration in the copying machine.

FIG. 3 is an enlarged configuration diagram depicting the configuration of the print section 100 on a magnified scale.

The print section 100 is provided with an endless intermediate transfer belt 10 serving as an intermediate transfer member. As the material for the intermediate transfer belt 10, from the viewpoint of preventing misalignment due to belt stretch, polyimide having excellent mechanical characteristics is used. Polyimide contains carbon serving as an electric resistance regulator which is dispersed so as to achieve high quality and high stability, that is, so as to constantly obtain stable transfer performance without depending on the temperature and humidity environment. For this reason, the intermediate transfer belt 10 looks black.

The intermediate transfer belt 10 moves in a clockwise direction of FIG. 3 endlessly in a state of being stretched by three support rollers 14, 15, and 16. As depicted in FIG. 3, four image forming units 18Y, 18C, 18M, and 18K of yellow (Y), cyan (C), magenta (M), and black (K) are arranged in parallel in a stretched belt portion between the first support roller 14 and the second support roller 15 from among the support rollers 14, 15, and 16. An optical sensor 110, serving as a stuck toner amount detection unit, which detects a reference toner image formed on the intermediate transfer belt 10, is provided in a stretched belt portion between the first support roller 14 and the third support roller 16.

As depicted in FIG. 2, a laser writing device 21 serving as a latent image writing unit is provided above the image forming units 18Y, 18C, 18M, and 18K. The laser writing device 21 which constitutes an image forming means together with the image forming units 18Y, 18C, 18M, and 18K drives a semiconductor laser (not shown) with a laser control section (not shown) on the basis of image information of a document read by the scanner 300 to emit writing light. The drum-shaped photosensitive elements 20Y, 20C, 20M, and 20K serving as a latent image carrier provided in the image forming units 18Y, 18C, 18M, and 18K respectively are exposed to the writing light and scanned to form electrostatic latent images on the photosensitive elements. The light source of the writing light is not limited to a laser diode and may be, for example, an LED.

Figure 4:
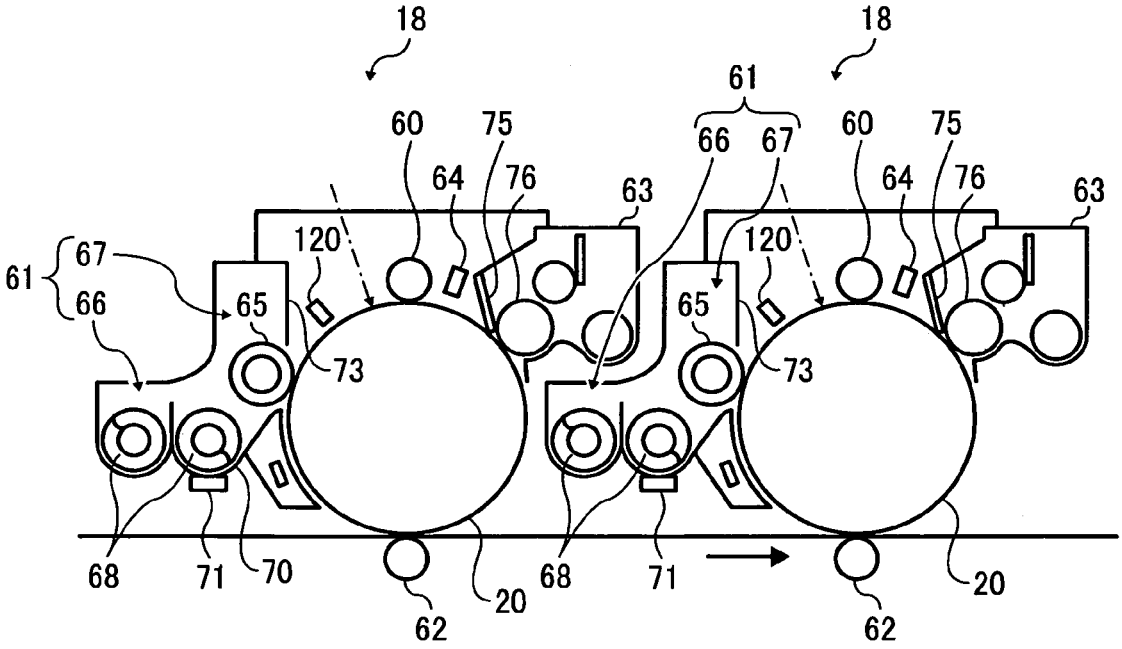
FIG. 4 is an enlarged configuration diagram depicting two of four image forming units in the copying machine.

FIG. 4 is an enlarged configuration diagram depicting two of the four image forming units 18Y, 18C, 18M, and 18K.

The four image forming units 18Y, 18C, 18M, and 18K have the same configuration, except that toner of different colors is used. In FIG. 4, the suffixes Y, C, M, and K attached to the end of reference numeral of each member are omitted. In the following description, if necessary, the suffixes will be appropriately omitted.

An image forming unit 18 is provided with, around a photosensitive element 20: a charging device 60 serving as a charging unit; a developing device 61 serving as a developing unit; a photosensitive element cleaning device 63 serving as a cleaning unit; and a neutralization device 64 serving as a neutralization unit. A primary transfer device 62 serving as a transfer means is provided at a position facing the photosensitive element 20 with the intermediate transfer belt 10 therebetween.

The charging device 60 is a contact charging type device that adopts a charging roller. The charging device 60 comes into contact with the photosensitive element 20 and applies a voltage to uniformly charge the surface of the photosensitive element 20. As the charging device 60, a non-contact charging type charging device using a non-contact scorotron charger or the like may be used.

In the developing device 61, a two-component developer is used; and the two-component developer contains a magnetic carrier and non-magnetic toner. As the developer, a one-component developer may be used. The developing device 61 may be broadly divided into a stirring section 66 and a developing section 67 provided in a developing case 70. In the stirring section 66, the two-component developer (hereinafter, simply referred to as "developer") is conveyed while being stirred and is supplied onto a developing sleeve 65, which is described below and serves as a developer carrier. The stirring section 66 is provided with two screws 68 arranged in parallel, and a partition plate is provided between the two screws 68 such that both end portions are communicated with each other. A toner density sensor 71, which detects the toner density of the developer in the developing device 61, is attached to the developing case 70. Meanwhile, in the developing section 67, toner in the developer stuck to the developing sleeve 65 is transferred to the photosensitive element 20. The developing section 67 is provided with the developing sleeve 65 facing the photosensitive element 20 through an opening of the developing case 70, and a magnet (not shown) is fixedly arranged in the developing sleeve 65. A doctor blade 73 serving as a developer regulating member is provided such that the tip thereof comes close to the developing sleeve 65.

In the developing device 61, the developer is conveyed and rotated while being stirred by the two screws 68 and is supplied to the developing sleeve 65. The developer supplied to the developing sleeve 65 is pumped up to the surface of the developing sleeve 65 by magnetic force generated by a magnet roller provided in the developing sleeve 65. The developer pumped up to the surface of developing sleeve 65 is conveyed in accordance with rotation of the developing sleeve 65. The amount of the developer remaining on the surface of developing sleeve 65 is controlled to an appropriate amount by the doctor blade 73. The developer removed by the control returns to the stirring section 66. In this way, the developer conveyed to the developing area facing the photosensitive element 20 becomes a state of developer chains by magnetic force generated by the magnet roller and forms a magnetic brush.

In the developing area, a predetermined developing gap is formed between the photosensitive element 20 and the developing sleeve 65. A developing electric field which moves toner in the developer to the electrostatic latent image portion on the photosensitive element 20 is formed by the developing bias which is applied to the developing sleeve 65. Thus, the toner in the developer is transferred to the electrostatic latent image portion on the photosensitive element 20, and the electrostatic latent image on the photosensitive element 20 is visualized, such that a toner image is formed. The developer having passed through the developing area is conveyed to a portion where the magnetic force of the magnet is weak, is separated from the developing sleeve 65, and returns to the stirring section 66. With the repetition of such an operation, if the toner density in the stirring section 66 is lowered, the toner density sensor 71 detects the lowering of the toner density and toner is replenished to the stirring section 66 on the basis of the detection result.

As the primary transfer device 62, a primary transfer roller is employed and pressed into contact with the photosensitive element 20 with the intermediate transfer belt 10 sandwiched therebetween. The primary transfer device 62 may be a conductive brush type or a non-contact corona charger, instead of a roller type.

The photosensitive element cleaning device 63 includes a cleaning blade 75 made of, for example, polyurethane rubber which is arranged such that the tip thereof is pressed into contact with the photosensitive element 20. In the present embodiment, in order to enhance cleaning performance, a conductive fur brush 76 is also used, where the conductive fur brush 76 is in contact with the photosensitive element 20. Toner removed from the photosensitive element 20 by the cleaning blade 75 or the fur brush 76 is accommodated inside the photosensitive element cleaning device 63. The neutralization device 64, including a neutralization lamp or the like, irradiates the photosensitive element 20 with a light to initialize the surface potential of the photosensitive element 20.

The image forming unit 18 is also provided with a potential sensor 120 which serves as a surface potential detection unit facing the photosensitive element 20. The potential sensor 120 is disposed so as to face the photosensitive element 20 and detects the surface potential of the photosensitive element 20. Referring to FIG. 4, the surface of the photosensitive element 20 may be uniformly charged to, for example, −700 V by the charging device 60; and the potential of the electrostatic latent image portion which is irradiated with the writing light by the laser writing device 21 becomes, for example, −120 V. Meanwhile, the voltage of the developing bias is set to −470 V, and the developing potential of 350 V is ensured. These process conditions are appropriately changed in accordance with the result of potential set value adjustment control described below.

Referring to FIG. 2 described above, in the image forming unit 18, with the rotation of the photosensitive element 20, first, the surface of the photosensitive element 20 may be uniformly charged by the charging device 60. Next, based on the image information read by the scanner 300; the photosensitive element 20 is irradiated with the writing light, which is laser, generated from the laser writing device 21; then an electrostatic latent image is formed on the photosensitive element 20. Thereafter, the electrostatic latent image is visualized by the developing device 61, such that a toner image is formed. The toner image is primarily transferred to the intermediate transfer belt 10 by the primary transfer device 62.

After the primary transfer, transfer residual toner on the surface of the photosensitive element 20 is removed by the photosensitive element cleaning device 63, and then the surface of the photosensitive element 20 is neutralized by the neutralization device 64 preparing for the next image formation.

The image forming unit 18 is configured such that the developing device 61 and the process unit in which other devices (the photosensitive element 20 and the like) are mounted can be separated from each other. The developing device 61 and the process unit can be independently replaced. When the developing device 61 is replaced, the developing sleeve 65 becomes a new one. When the process unit is replaced, the photosensitive element 20 becomes a new one.

As previously shown in FIG. 3, a secondary transfer roller 24 serving as a second transfer device is provided at a position facing the third support roller 16 among the support rollers. When the toner image on the intermediate transfer belt 10 is secondarily transferred to the transfer sheet 5, the secondary transfer roller 24 is pressed onto the intermediate transfer belt portion wound around the third support roller 16, and then secondary transfer is conducted. The secondary transfer device is not limited to the configuration using the secondary transfer roller 24, and may be constituted by, for example, a transfer belt or a non-contact transfer charger. A roller cleaning section 91 is in contact with the secondary transfer roller 24 to clean toner stuck to the secondary transfer roller 24.

On the downstream side of the secondary transfer roller 24 in the conveying direction of the transfer sheet 5; an endless belt-shaped conveying belt 22 that stretches between two rollers 23*a* and 23*b* is provided. On the further downstream side in the conveying direction, a fixing device 25 is provided to fix the toner image onto the transfer sheet 5. The fixing device 25 is configured such that a pressing roller 27 is pressed onto a heating roller 26. A belt cleaning device 17 is provided at a position facing the second support roller 15 among the support rollers of the intermediate transfer belt 10. The belt cleaning device 17 is provided to remove residual toner on the intermediate transfer belt 10 after the toner image on the intermediate transfer belt 10 is transferred to the transfer sheet 5.

As depicted in FIG. 2, the print section 100 is provided with a conveying path 48 in which the transfer sheet 5 fed from the feeding device 200 passes through the secondary transfer roller 24 and is guided to the discharge tray 7. A carriage roller 49*a*, a registration roller 49*b*, a discharging roller 56, and the like are also provided along the conveying path 48. On the downstream side of the conveying path 48, a switching claw 55 is provided to switch the conveying direction of the transfer sheet 5 after transfer to the discharge tray 7 or a sheet reversing device 93. The sheet reversing device 93 reverses the transfer sheet 5 and again sends the transfer sheet toward the secondary transfer roller 24. The print section 100 is also provided with a bypass feed path 53 which passes from the bypass tray 6 to join the conveying path 48. On the upstream side of the bypass feed path 53, a paper feeding roller 50 and a separating roller 51 are provided to feed the transfer sheets 5 set in the bypass tray 6 one by one.

The feeding device 200 includes: a plurality of paper cassettes 44 which accommodate the transfer sheets 5; a paper feeding roller 42 and a separating roller 45 which feed the transfer sheet accommodated in the paper cassettes 44 one by one; a carriage roller 47 which conveys the fed transfer sheet along a feed path 46; and the like. The feed path 46 is connected to the conveying path 48 of the print section 100.

In the scanner 300, in order to read and scan an original document (not shown) placed on a contact glass 31, a first and a second traveling members 33 and 34, on which a document illumination light source and a mirror are mounted, reciprocate. Image information scanned by the traveling members 33 and 34 is collected, by an imaging lens 35, to the imaging surface of a reading sensor 36 provided at the back of the imaging lens 35 and read as an image signal by the reading sensor 36.

Figure 5:
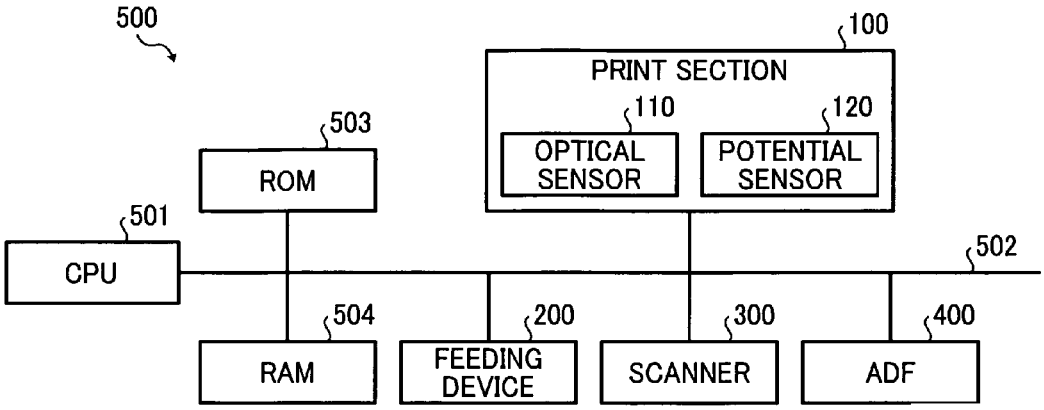
FIG. 5 is a block diagram depicting a main part of an electric circuit in the copying machine.

FIG. 5 is a block diagram depicting a main part of an electric circuit in the copying machine of the present embodiment.

As depicted in FIG. 5, the copying machine includes a main control section 500 which is constituted by a computer, and the main control section 500 performs driving control of respective sections. The main control section 500 is configured such that a ROM (Read Only Memory) 503 and a RAM (Random Access Memory) 504 are connected to a CPU (Central Processing Unit) 501 through a bus line 502. The CPU 501 performs various operations or driving control of the respective sections. The ROM 503 stores fixed data, such as a computer program, in advance. The RAM 504 functions as a work area which rewritably stores various kinds of data. The ROM 503 stores a conversion table (not shown) which stores information regarding conversion to the stuck toner amount per unit area with respect to the output value of the optical sensor 110. To the main control section 500 are connected the respective sections of the print section 100, the feeding device 200, the scanner 300, and the automatic document feeder 400. The optical sensor 110 and the potential sensor 120 of the print section 100 send detected information to the main control section 500.

Figure 6:
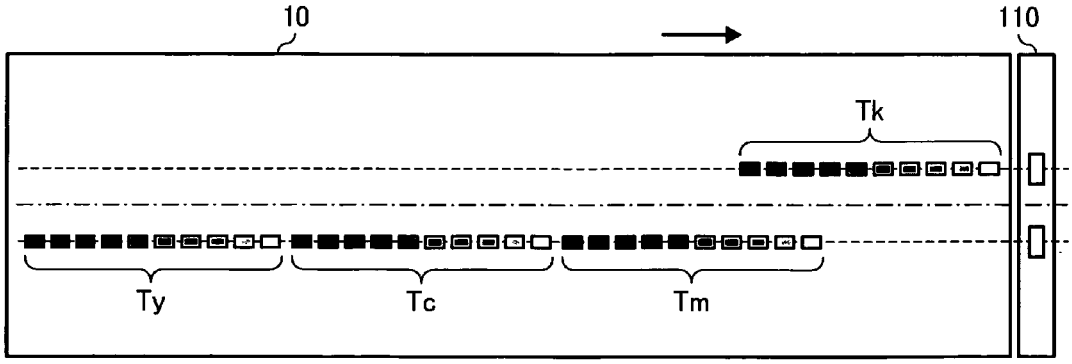
FIG. 6 is a schematic view depicting an intermediate transfer belt in the copying machine and a gradation pattern image formed on the surface of the intermediate transfer belt.

A control section (a combination of the CPU 501, the ROM 503, and the RAM 504) serving an image density adjustment unit of the present copying machine is configured to perform image forming condition adjustment control to adjust image density or the like, called potential set value adjustment control, immediately after the power switch (not shown) is turned on. According to the potential set value adjustment control; in the four image forming units 18Y, 18C, 18M, and 18K, gradation pattern images are formed on the surfaces of the photosensitive elements 20Y, 20C, 20M, and 20K; and the formed gradation pattern images are transferred to the intermediate transfer belt 10. Each of the gradation pattern images of the respective colors of Y, M, C, and K has a plurality of reference patches (reference toner images) with the stuck toner amount per unit area are different one another; and transferred to the intermediate transfer belt 10, for example, in the state of FIG. 6. Specifically, an M gradation pattern image Tm having a plurality of M reference patches, a C gradation pattern image Tc having a plurality of C reference patches, a Y gradation pattern image Ty having a plurality of Y reference patches are transferred to be arranged linearly in order of M, C, and Y in the belt movement direction. Meanwhile, a K gradation pattern image Tk having a plurality of K reference patches is transferred at a position different from other gradation pattern images in the belt width direction.

In the potential set value adjustment control, each reference patch in the gradation pattern image (for example, 10 gradation pattern) formed on the intermediate transfer belt 10 is detected by the optical sensor 110, and an appropriate development γ (gamma) is calculated on the basis of an output voltage value corresponding to each reference patch. The target charging potential of the photosensitive element surface (hereinafter, simply referred to as "target charging potential"), developing bias, and optical writing intensity (exposure intensity) capable of obtaining target image density are specified on the basis of the calculation result, and the set values thereof are stored. The development γ is the gradient of a graph which represents the relationship between the developing potential and the stuck toner amount per unit area.

Figure 7:
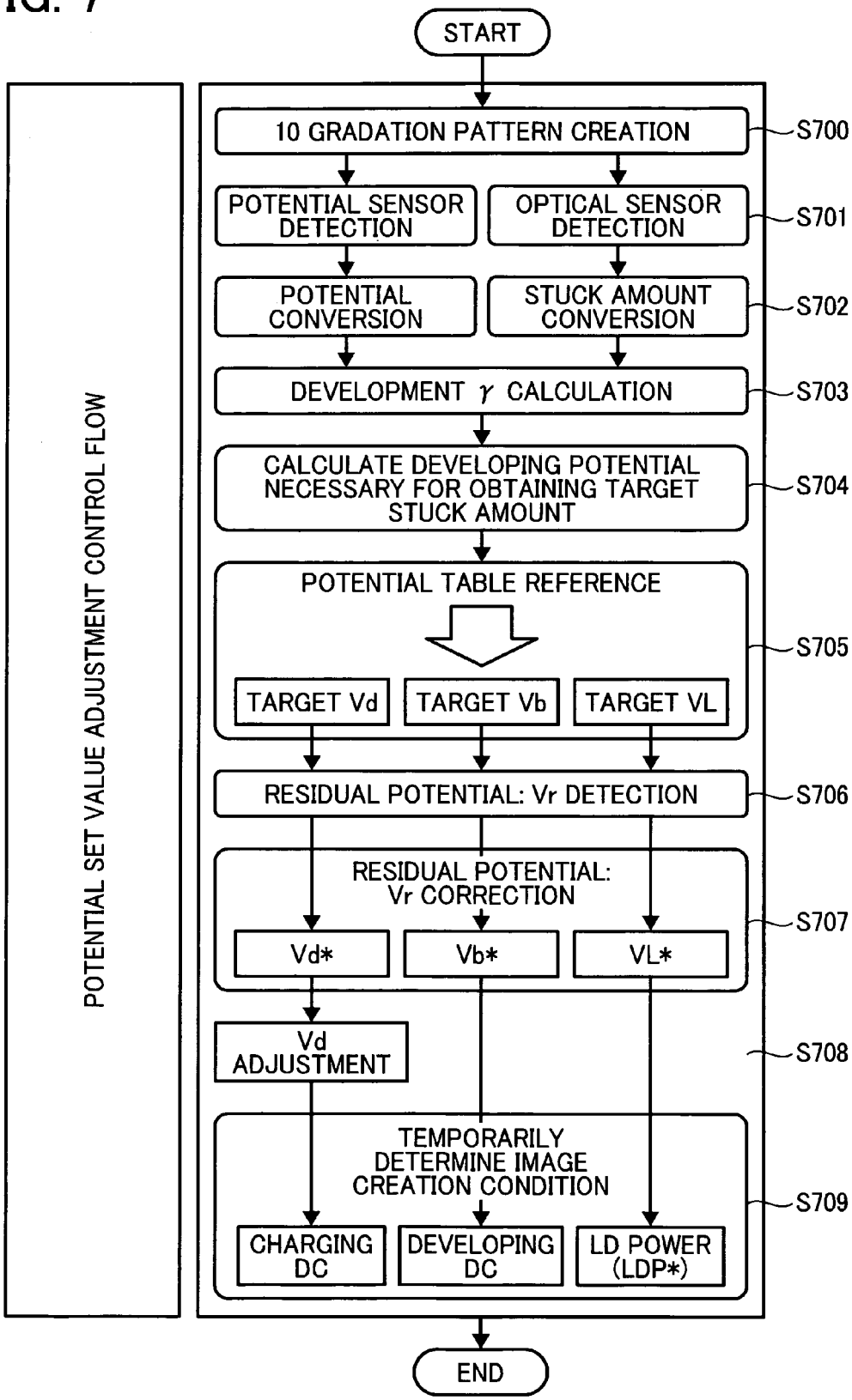
FIG. 7 is a flowchart depicting a control flow of potential set value adjustment control in the copying machine.

FIG. 7 is a flowchart depicting a control flow in the potential set value adjustment control in the present copying machine.

In the potential set value adjustment control, first, a Y-10 gradation pattern image, a C-10 gradation pattern image, an M-10 gradation pattern image, and a K-10 gradation pattern image each having 10 different reference patches with the stuck toner amount different one another are formed (S700). The stuck toner amount per unit area of each of the gradation pattern images is detected by the optical sensor 110, and the output result is stored in the RAM 504. At this time, the output voltage of the potential sensor 120 for the potential of each gradation pattern portion potential (the potential of each electrostatic latent image) on the photosensitive element 20 is simultaneously read and stored in the RAM 504 (S701). Next, the developing potential is calculated from the potential output value of the potential sensor 120 stored in the RAM 504 and the developing bias at the time of pattern forming (S702). At the same time, the stuck toner amount in each patch is obtained with reference to the stuck amount conversion table (not shown). After the stuck toner amount is calculated, next, the development γ is calculated (S703). With regard to the 10 gradation pattern image of each of Y, C, M, and K, the toner images of each gradation is formed at a predetermined place in the circumferential direction of the photosensitive element, specifically, at a place of Measurement No. 1 described below. Thus, in forming the 10 gradation pattern image, the photosensitive element is rotated ten times, and the toner image of the corresponding gradation in each rotation is formed at the place of Measurement No. 1.

Figure 8:
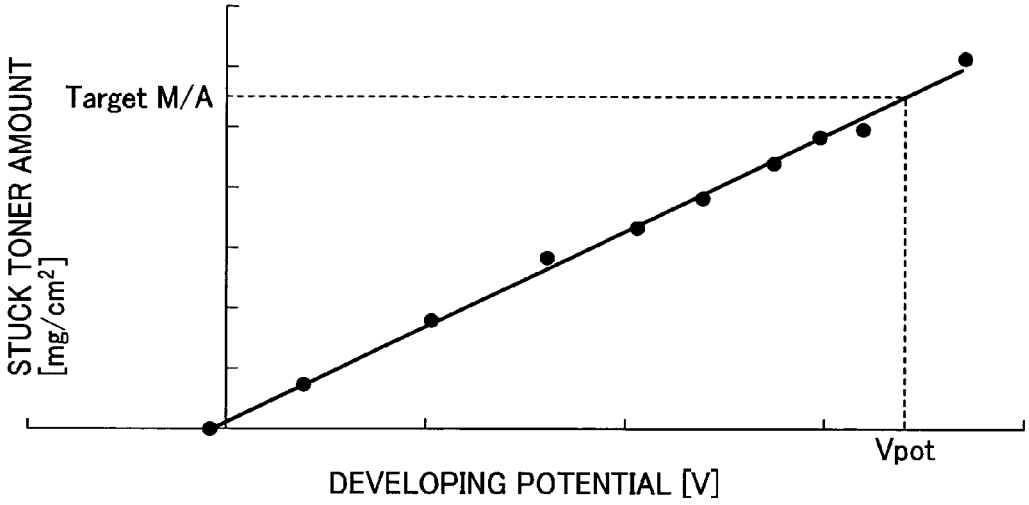
FIG. 8 is a graph depicting the relationship (development γ characteristic) between a developing potential specified by the detection result of a gradation pattern image and the stuck toner amount of each reference patch.

FIG. 8 is a graph depicting the relationship between the developing potential obtained in S702 and the stuck toner amount of each reference patch.

In S703, a linear approximate equation (gradient thereof is the development γ and an intercept on the horizontal axis is referred to as a developing start voltage) is calculated. After the development γ is calculated, next, as depicted in FIG. 8, a developing potential Vpot necessary for obtaining a target stuck toner amount Target M/A is specified on the basis of the development γ (S704). Then, the charging potential of the photosensitive element matched with the developing bias, the developing bias, and the exposed portion potential (electrostatic latent image potential) are respectively specified as a target charging potential Vd, a target developing bias potential Vb, and a target exposed portion potential (electrostatic latent image potential) VL on the basis of a potential table (not shown) (S705).

After the target potentials Vd, Vb, and VL are specified in the above-described manner, a laser control circuit (not shown) which controls the laser writing device 21 performs control such that the laser emission power of a semiconductor laser is maximized, and the output value of the potential sensor 120 is loaded to detect the residual potential of the photosensitive element 20 (S706). When the residual potential is not 0, the target potentials Vd, Vb, and VL previously specified in S705 are corrected by the amount of the residual potential (S707). Hereinafter, the target potentials after correction are respectively denoted by Vd*, Vb*, and VL*.

Thereafter, a power supply circuit (not shown) is adjusted such that the charging potential of the photosensitive element 20 by the charging device 60 becomes the target charging potential Vd* concurrently for each color (S708). While the laser emission power of the semiconductor laser is changed in a stepwise manner through the laser control circuit, the surface of each of the photosensitive elements, which is uniformly charged with each laser emission power, is irradiated with laser, and the potential (latent image potential) of the irradiated portion is detected by the potential sensor 120. After the linear equation of a graph depicted in FIG. 9 is obtained on the basis of the detection result, laser emission power LDP* is obtained on the basis of the linear equation such that the exposed portion potential of the photosensitive element 20 becomes the target exposed portion potential VL*.

Figure 9:
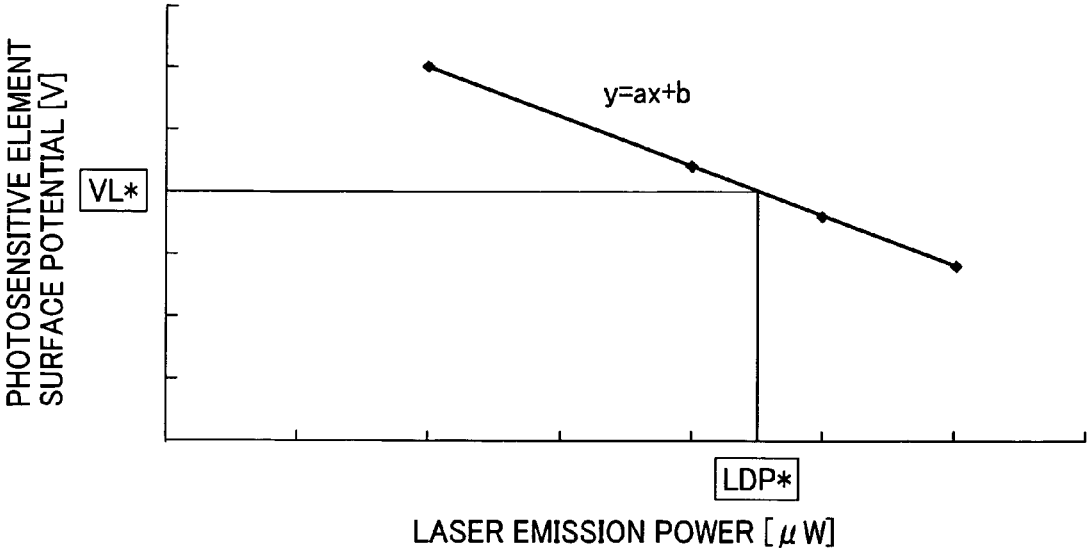
FIG. 9 is a graph depicting the relationship between laser emission power obtained by potential set value adjustment control and photosensitive element exposed portion potential.

FIG. 9 is a graph depicting the relationship between the laser emission power and the exposed portion potential of the photosensitive element.

As depicted in FIG. 9, the relationship between the laser emission power and the exposed portion potential of the photosensitive element is expressed by a linear approximate equation y=ax+b. The gradient "a" and the intercept "b" of the linear approximate equation are stored in the RAM 504. Then, the power supply circuit is adjusted such that the developing bias of each of a black developing device 61K, a cyan developing device 61C, a magenta developing device 61M, and a yellow developing device 61Y becomes the target developing bias potential Vb*, and subsequently the adjusted values are stored as a temporary image forming condition at the time of a print operation (S709).

In this way, the processing for the potential set value adjustment control ends.

Assuming that the developing gap is d •[m] and the developing potential which is obtained by the potential set value adjustment control is Vpot [V], the developing electric field intensity E [V/m] is obtained by the following expression (1).

$$E=V\text{pot}/d \tag{1}$$

When the photosensitive element 20 and the developing sleeve 65 are driven to rotate, the developing gap varies depending on the deflection (deflection due to eccentricity) of each of the photosensitive element 20 and the developing sleeve 65 in the developing gap, varying the developing electric field intensity E. When the developing electric field intensity E varies, the toner amount which is moved to the electrostatic latent image on the photosensitive element 20 also varies. Thus, irregularity in image density occurs in an output image due to variation in the developing gap caused by the deflection of the outer circumference of the photosensitive element 20 or the developing sleeve 65.

Irregularity in image density also occurs due to errors in a circumferential direction of latent image writing sensitivity representing easiness of writing a latent image on the photosensitive element 20. The errors in the circumferential direction of latent image writing sensitivity cause errors of the latent image potential and consequently errors of the developing electric field intensity E. For example, it is assumed that the uniform charging potential of the photosensitive element 20 is Vd [V], laser power for creating a latent image is ϵ [J], latent image writing sensitivity at an arbitrary place in the circumferential direction of the photosensitive element 20 is $A_1$ [V/J], and the latent image potential at that place is $VL_1$ [V]. It is also assumed that latent image writing sensitivity at another place is $A_2$ [V/J] and the latent image potential at that place is $VL_2$ [V]. Then, the latent image potentials $VL_1$ [V] and $VL_2$ [V] at the former and latter places are obtained by the following expressions.

$$\bullet VL_1=Vd-\epsilon\times A_1$$

$$\bullet VL_2=Vd-\epsilon\times A_2$$

In order to eliminate irregularity in image density due to the variation in the developing gap or the errors in the circumferential direction of latent image writing sensitivity of the photosensitive element 20, a technique is necessary for accurate component manufacturing with no deflection or for accurate photosensitive element surface processing with no irregularity in sensitivity. In recent years, with the high-speed operation of an electrophotographic image forming apparatus, the photosensitive element 20 or the developing sleeve 65 tends to be increased in diameter, and it is not easy to improve deflection accuracy and latent image sensitivity accuracy. Even if deflection accuracy or latent image sensitivity accuracy can be improved, there is a problem in that the cost of the apparatus increases with accuracy improvement.

Next, as the characteristic portion of the invention, developing electric field intensity control will be described in which the developing electric field intensity falls within an allowable range of a target electric field intensity.

In this copying machine, the RAM 504 serving as an information storage unit stores: a first deflection information table which includes information regarding deflection in a direction normal to the outer edge of the photosensitive element 20 in the developing gap; a second deflection information table which includes information regarding deflection in a direction normal to the outer edge of the developing sleeve 65 in the developing gap; and a writing sensitivity information table which includes information regarding errors in the circumferential direction of latent image writing sensitivity of the photosensitive element 20. The first deflection information table includes information which represents the relationship between the surface movement amount in the circumferential direction of the photosensitive element 20 and the deflection amount in the normal direction of the photosensitive element 20 in the developing gap. The second deflection information table includes information which represents the relationship between the surface movement amount in the circumferential direction of the developing sleeve 65 and the deflection amount in the normal direction of the developing sleeve 65 in the developing gap. Both of the surface movement amounts refer to the surface movement amount from when the home position sensor (not shown) detects that the photosensitive element 20 is at the home position of a predetermined rotation angle pose and sends a detection signal.

In the copying machine of the present embodiment, as a combination of the rotation speed of the photosensitive element 20 and the rotation speed of the developing sleeve 65, a combination is used in which, each time one rotates integer times, the other one rotates integer times. In the image forming unit 18, a photosensitive element gear fixed to the rotation shaft member of the photosensitive element 20 and a developing gear fixed to the rotation shaft member of the developing sleeve of the developing device 61 are meshed with each other directly or through a relay gear. Driving force received by the photosensitive element gear from the apparatus main body is transmitted from the photosensitive element gear to the developing gear. During a print job, the photosensitive element 20 is surely stopped in a state of a predetermined rotation pose. Thus, in attaching and detaching the image forming unit 18 to and from the apparatus main body, the photosensitive element 20 is surely in the predetermined rotation pose. At this time, the developing sleeve 65 is also surely in a predetermined rotation pose. The developing device 61 in condition of a fresh product is mounted with a rotation stopping pin for stopping the rotation of the developing sleeve 65. In this state, the developing sleeve 65 is in a predetermined rotation pose. Thus, if a worker separates the developing device 61 from the image forming unit 18 detached from the apparatus main body and mounts a new developing device, the developing sleeve 65 of the new developing device is in a predetermined rotation pose. In this state, the rotation stopping pin is removed from the new developing device 61. With this configuration, each place in the circumferential direction of the photosensitive element 20 of the process unit and each place in the circumferential direction of the developing sleeve 65 are synchronized with each other in a predetermined period in the developing gap in accordance with the rotation of the photosensitive element 20 and the developing sleeve 65. Thus, it is not necessary to detect the home positions of both of the photosensitive element 20 and the developing sleeve 65, and if the home position of either the photosensitive element 20 or the developing sleeve 65 is detected, the places of the photosensitive element 20 and the developing sleeve 65 facing each other in the developing gap can be recognized at an arbitrary timing. For this reason, in the copying machine of the embodiment, only for the photosensitive element 20, the home position sensor is provided.

When the photosensitive element 20 and the developing sleeve 65 are driven by separate motors, the following configuration may be made. That is, home position sensor is provided not only for the photosensitive element 20 but also provided for the developing sleeve 65. During a print job, at the time of starting the motors, the rotation phases of the motors are adjusted such that the home position detection timings of the home position sensors are synchronized with each other, and then image forming processing is performed. After the rotation phases of the motors are adjusted, the places of the photosensitive element 20 and the developing sleeve 65 facing each other in the developing gap are recognized on the basis of one of a home position detection timings.

Instead of detecting the home position by the home position sensor, the rotation angle position of the photosensitive element 20 or the developing sleeve 65 may be detected by a hall sensor using a hall element, a rotary encoder, or the like.

The RAM 504 also stores a gap variation information table which represents the relationship between the surface movement amount of the photosensitive element 20 from the home position detection timing and the size of the developing gap. The gap variation information table represents the size of the developing gap when a photosensitive element surface place in the developing gap from among a plurality of photosensitive element surface places in the first deflection information table is synchronized with a sleeve surface place in the developing gap from among a plurality of developing sleeve surface amounts in the second deflection information table. The main control section 500 serving as a control unit obtains a developing electric field intensity under the conditions of the developing gap and updates an image forming condition information table described below on the basis of the result.

Figure 1:
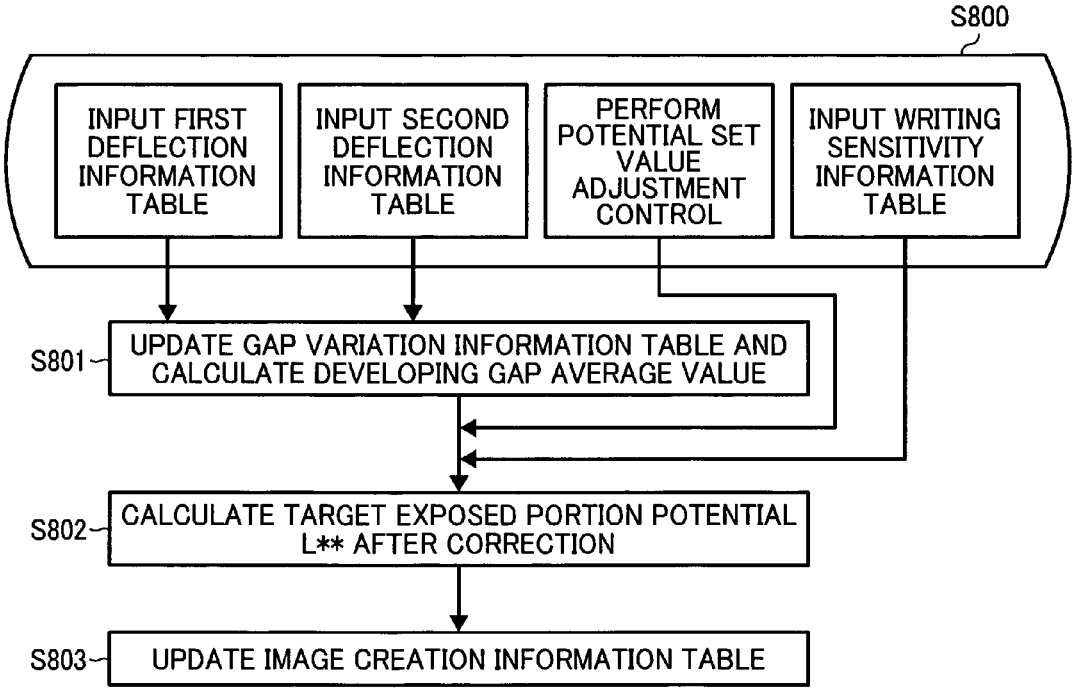
FIG. 1 is a flowchart depicting a control flow of developing electric field intensity control in a copying machine of an embodiment.

FIG. 1 is a flowchart depicting a control flow of developing electric field intensity control in the present copying machine.

In the present copying machine, in the four image forming units 18Y, 18C, 18M, and 18K, when the developing device 61 or the process unit is replaced and the first deflection information table, the second deflection information table, the writing sensitivity information table, and the like are newly input or the developing potential Vpot is updated through the above-described potential set value adjustment control, the CPU 501 determines to perform the developing electric field intensity control (S800).

The process unit of the image forming unit 18 is provided with a memory, serving as an information storage unit, which is constituted by an IC or the like, and the memory stores information of the unit ID number or the above-described first deflection information table and writing sensitivity information table. When the image forming unit 18 is set in the apparatus main body, electric conduction is provided between the memory and the main control section 500, and information is read to the main control section 500. The unit which provides electric conduction functions as an information input unit which inputs the first deflection information table or the writing sensitivity information table. On the basis that the read unit ID number is different from the previous number, the main control section 500 detects that the process unit is replaced.

The developing device 61 of the image forming unit 18 is provided with a memory serving as an information storage unit, and the memory stores information of the device ID number or the above-described second deflection information table. When the image forming unit 18 is set in the apparatus main body, electric conduction is provided between the memory and the main control section 500, information is read into the main control section 500. The unit which provides electric conduction functions as an information input unit which inputs the second deflection information table. On the basis that the read device ID number is different from the previous number, the main control section 500 detects that the developing device 61 is replaced.

The main control section 500 updates deflection combination information, which is a combination of the first deflection information table and the second deflection information table, on the basis of newly input (read) deflection information tables when it is detected that the process unit and the developing device 61 are replaced or another deflection information table stored in the RAM 504 when only one of the process unit and the developing device 61 is replaced. The value of each developing gap in the above-described gap variation information table is updated to the content corresponding to the deflection combination information after update (S801). The average value of all the developing gaps in the gap variation information table is also calculated (S801). Next, the developing electric field intensity at each developing gap is obtained, then, the target exposed portion potential VL* stored in the RAM 504 through the above-described potential set value adjustment control is corrected such that all the developing electric field intensities fall within the allowable range of the target electric field intensity, and a target exposed portion potential VL after correction is calculated (S802). Laser emission power LDP after correction is calculated on the basis of the target exposed portion potential VL after correction, the laser emission power stored in the RAM 504 through the above-described potential set value adjustment control, and the writing sensitivity information table of the photosensitive element 20 to update laser emission power which is image forming condition information (S803**).

Hereinafter, the details of each step will be described.

Figures 10, 11:
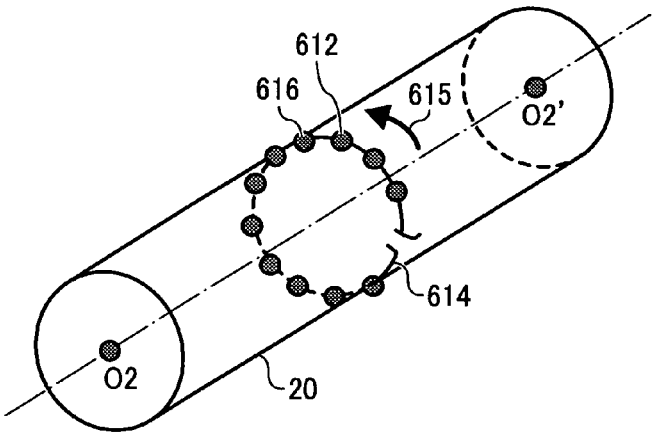
FIG. 10 is a perspective view depicting a deflection amount measurement point on a photosensitive element.
FIG. 11 is an explanatory view depicting the content of a first deflection information table including deflection amount data which is the measurement result at each deflection amount measurement point of a photosensitive element.

First, S800 will be described. FIG. 10 is a perspective view depicting a photosensitive element deflection amount measurement point. A plurality of photosensitive element surface movement amounts in the first deflection information table corresponds to photosensitive element surface places in the developing gap with each movement amount. These photosensitive element surface places are all on a virtual plane orthogonal to a line O2-O2' which is the rotation center axis of the photosensitive element 20 and on an outer circumferential line 614 of the photosensitive element 20 which passes through the detection area of the potential sensor 120. In this embodiment, the first deflection information table is acquired by setting a deflection measurement device, for example, a dial gauge, at a deflection amount measurement reference point 612 and rotating the photosensitive element 20 in a direction indicated by an arrow 615 in the drawing once with the deflection at the deflection amount measurement reference point 612 being zero. The arrow 615 is the same as the rotation driving direction of the photosensitive element 20 in the print section 100. The deflection amount measurement is carried out by a predetermine angle (in terms of [deg]), and deflection in a direction toward the rotation center axis of the photosensitive element 20 is denoted as – (minus). The number of deflection amount measurement points, that is, the number of pieces of data representing the photosensitive element surface movement amount in the first deflection information table is determined by an integer n2 [pieces] including the deflection information table of the deflection amount measurement reference point 612. A deflection amount measurement point denoted by reference numeral 616 in the drawing is measured at the n2-th time (last). As depicted in FIG. 11, in the first deflection information table, the measurement information of the deflection amount is described as a photosensitive element deflection amount in a table area represented by reference numeral 660 in the drawing and data of the n2-th photosensitive element deflection amount is described in a table area represented by reference numeral 661 in the drawing. In the first deflection information table, the measurement No. represents the surface movement amount of the photosensitive element 20.

Figures 12, 13:
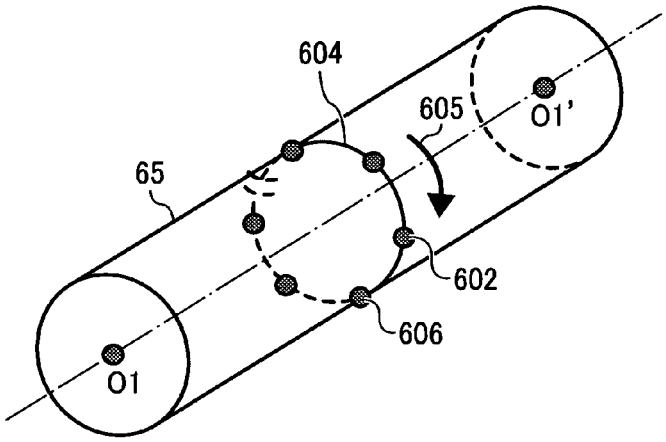
FIG. 12 is a perspective view depicting a deflection amount measurement point on a developing sleeve.
FIG. 13 is an explanatory view depicting the content of a second deflection information table including deflection amount data which is the measurement result at each deflection amount measurement point of a developing sleeve.

FIG. 12 is a perspective view depicting a sleeve deflection amount measurement point.

The sleeve deflection amount measurement points are all on a virtual plane orthogonal to a line O1-O1' which is the rotation center axis of the developing sleeve 65 and on an outer circumferential line 604 of the developing sleeve 65 facing the outer circumferential line 614 of the photosensitive element 20. In this embodiment, the second deflection information table of the developing sleeve 65 is acquired by setting a deflection measurement device, for example, a dial gauge, at a deflection amount measurement reference point 602 and rotating the developing sleeve 65 in a direction indicated by an arrow 605 in the drawing once with the deflection at the deflection amount measurement reference point 602 being zero. The arrow 605 is the same as the rotation driving direction of the developing sleeve 65 in the print section 100. The deflection amount measurement is carried out by a predetermined angle (in terms of [deg]), and deflection in a direction toward the rotation center axis of the developing sleeve 65 is denoted as – (minus). The number of times of deflection amount measurement, that is, the number of deflection amount measurement points is determined by an integer n1 [pieces] including the deflection information table of the deflection amount measurement reference point 602. A deflection amount measurement point denoted by reference numeral 606 is measured at the n1-th time (last). As depicted in FIG. 13, with regard to sleeve deflection amount measurement information, deflection amount data of the deflection amount measurement reference point 602 is described in a table area represented by reference numeral 650 in the drawing, and deflection amount data of the n1-th sleeve deflection amount measurement point 606 is described in a table area represented by reference numeral 651 in the drawing. The n1 pieces of deflection amount data are repeatedly described $\{(n2/n1)-1\}$ times, that is, until the number of rows of sleeve deflection amount measurement information (the number of pieces of deflection amount data) reaches n2, creating sleeve deflection amount measurement information. The sleeve deflection amount measurement information is measured in advance before each developing sleeve 65 is mounted in the print section 100 because of an individual difference between the developing sleeves 65, and in mounting each developing sleeve 65 in the print section 100 of the copying machine, the sleeve deflection amount measurement information corresponding to the relevant developing sleeve 65 is stored in the RAM 504 of the main control section 500 of the copying machine. In the data table, the measurement No. represents the surface movement amount of the developing sleeve 65. In the second deflection information table, the measurement No. represents the surface movement amount of the developing sleeve 65.

In the present embodiment, in attaching the developing sleeve 65 and the photosensitive element 20 to the print section 100, the positional relationship in which the deflection amount measurement reference points 602 and 612 face each other in the developing gap is regarded as a home position. The developing gap d1 [m] is measured with, for example, a thickness gauge or the like, and the measurement value is stored as home position gap information in the RAM 504 of the main control section 500.

If information is stored or rewritten in the RAM 504 in such a manner, the CPU 501 determines that the developing electric field intensity control is necessary, and performs control of the next step.

Figures 14, 15:
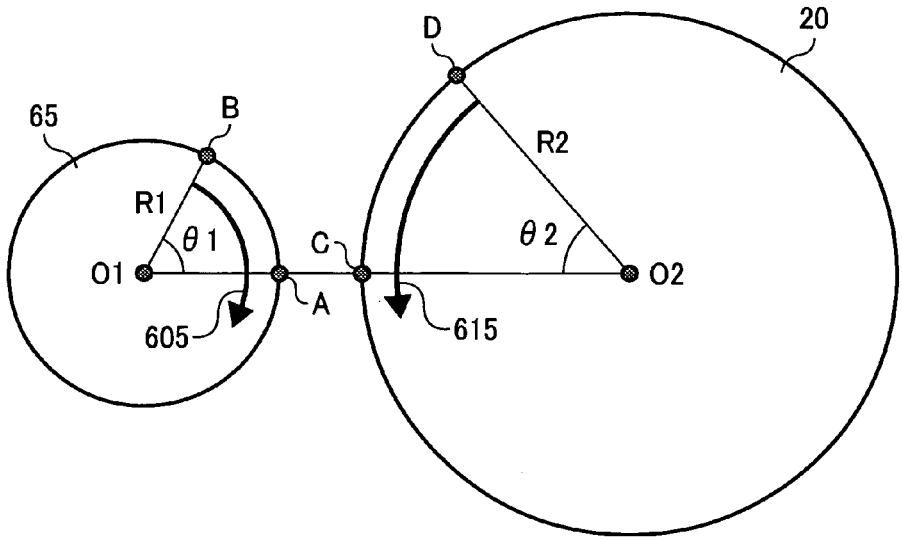
FIG. 14 is an explanatory view depicting the content of a gap variation information table.
FIG. 15 is an explanatory view depicting the rotational position relationship between a photosensitive element and a developing sleeve in the copying machine.

Next, S801 will be described. In this step, the gap variation information table depicted in FIG. 14 is updated on the basis of the first deflection information table, the writing sensitivity information table, the second deflection information table, and the home position gap information stored in the RAM 504. The value of the home position gap information, that is, the developing gap measurement value d1 [m] at the home position is described as developing gap data in a table area represented by reference numeral 670 in the drawing. Developing gap data described in another table area is a value obtained by subtracting the developing gap measurement value d1 at the home position from the sum of each piece of deflection amount data of the photosensitive element 20 depicted in FIG. 11 and each piece of deflection amount data of the developing sleeve 65 depicted in FIG. 13 (a value obtained by adding d1 to the sum when the positive and negative of deflection amount data are reversely defined). The average value $d_{ave}$ [m] of developing gap data in the gap variation information table created in such a manner is calculated by the CPU 501 of the main control section 500 and stored in the RAM 504.

When the developing sleeve 65 and the photosensitive element 20 are driven to rotate, it is necessary to align such that the deflection amount measurement points of the developing sleeve 65 and the photosensitive element 20 face each other in the developing area. For this reason, the angular velocity ratio (ω1/ω2) of the rotation angular velocity ω1 [rad/s] of the developing sleeve 65 and the rotation angular velocity ω2 [rad/s] of the photosensitive element 20 is set to coincide with the ratio (n2/n1) of the number of times of deflection amount measurement in the developing sleeve 65 and the photosensitive element 20 (the number of deflection amount measurement points). The reason will be described below.

FIG. 15 is an explanatory view depicting the rotational position relationship between the photosensitive element 20 and the developing sleeve 65 in one of the four image forming units 18Y, 18C, 18M, and 18K.

The developing sleeve 65 has a cylindrical shape having a radius R1 [m] and is driven to rotate at an angular velocity of ω1 [rad/s] in a direction indicated by the arrow 605 in the drawing. The photosensitive element 20 has a drum shape having a radius R2 [m] and is driven to rotate at an angular velocity ω2 [rad/s] in a direction indicated by the arrow 615 in the drawing. An angle denoted by reference numeral θ1 in the drawing represents a center angle between each deflection amount measurement point of the developing sleeve 65 and the central portion of the developing area, and an angle denoted by reference numeral θ2 in the drawing represents a center angle between each deflection amount measurement point of the photosensitive element 20 and the central portion of the developing area.

When an arbitrary deflection amount measurement point A in the developing sleeve 65 and an arbitrary deflection amount measurement point C in the photosensitive element 20 face each other in the developing area, in order that deflection amount measurement points B and D which next reaches the developing area reach the developing area after the same time t [s] elapses and face each other in the developing area, the following expression (2) has to be established.

$$t=\theta 1/\omega 1=\theta 2/\omega 2 \quad (2)$$

Here, since θ1=360/n1 and θ2=360/n2, the above-described expression (2) can be modified to the following expression (3).

$$(\omega 1/\omega 2)=n2/n1 \quad (3)$$

Thus, if the above-described expression (3) is established, each deflection amount measurement point on the photosensitive element 20 and each deflection amount measurement point of the developing sleeve 65 can be in phase and can constantly face each other in the developing area.

Next, S802 will be described. In this step, the target exposed portion potential VL** after correction is calculated on the basis of the target exposed portion potential VL* obtained in S707 of the above-described potential set value adjustment control and the gap variation information table depicted in FIG. 14.

Here, if the developing potential under the image forming condition temporarily determined through the potential set value adjustment control is Vpot [V], the following expression (4) is established.

$$V\text{pot}=Vb^*-VL^* \quad (4)$$

Referring to FIG. 14, if a k-th developing gap is $d_k$ [m] and the target exposed portion potential VL after correction in the developing gap is $VL^{}_k$, in order to maintain the developing electric field intensity E constant, the following expression (5) has to be established by the above-described expression (1).

$$E=V\text{pot}/d_{ave}=(Vb^*-VL^*/d_{ave}=(Vb^*-VL^{**}_k)/d_k \quad (5)$$

In this expression, "$V\text{pot}/d_{ave}$" corresponds to the reference value of the developing electric field intensity E. The following expression (6) is obtained from the above-described expression (5).

$$VL^{**}_k=Vb^*-(Vb^*-VL^*)\times(d_k/d_{ave}) \quad (6)$$

Next, S803 will be described. FIG. 18 depicts the writing sensitivity information table which is stored in the RAM 504 or the IC of the process unit. As depicted in FIG. 18, in this embodiment, with regard to latent image writing sensitivity, information of a linear approximate equation representing the relationship between the laser emission power LDP* and the photosensitive element exposed portion potential VL* is individually related to different places (the measurement Nos.) in the circumferential direction of the photosensitive element. For example, latent image writing sensitivity at the place of Measurement No. 1 is expressed by a linear approximate equation "$y=a_1x+b_1$". In the linear approximate equation, as previously depicted in FIG. 9, the y axis represents the photosensitive element exposed portion potential VL* and the x axis represents the laser emission power LDP*.

In S803, for the place of each measurement No. in the photosensitive element, the gradient ($a_K$) and the intercept ($b_k$) of the corresponding linear approximate equation are specified from the writing sensitivity information table depicted in FIG. 18. The laser emission power $LDP^{}_k$ after correction corresponding to each target exposed portion potential $VL^{}_k$ after correction is calculated by the following expression (7).

$$LDP^{}_k=(VL^{}_k-b_k)a_k \quad (7)$$

The target exposed portion potential $VL^{}_k$ after correction obtained in such a manner can cancel the deviation from the reference value of the developing electric field intensity E due to the variation in the developing gap caused by the deflection of the photosensitive element 20 and the developing sleeve 65 or the errors in the circumferential direction of latent image writing sensitivity of the photosensitive element 20** with the deviation in the opposing direction caused by changing the laser emission power from LDP*. Therefore, the developing electric field intensity can be substantially constant, reducing irregularity in image density.

Figures 16, 17:
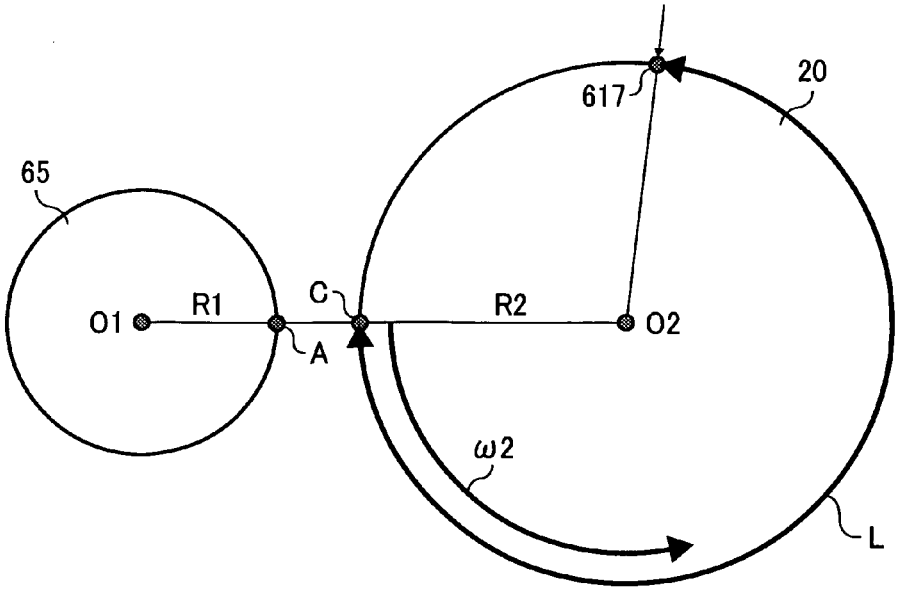
FIG. 16 is an explanatory view depicting the content of an image forming condition information table.
FIG. 17 is an explanatory view depicting the positional relationship between the rotational position of each of a photosensitive element and a developing sleeve in the copying machine and a laser writing position.

The time t [s] in the image forming condition information table depicted in FIG. 16 is the same as the time t [s] in the above-described expression (2). The image forming condition information table is used in controlling the laser emission power of the semiconductor laser through the laser control circuit (not shown) which controls the laser writing device 21. Specifically, during a print job, the main control section 500 changes the laser emission power (latent image writing intensity) serving as the image forming condition to a value based on the surface movement amount (the rotation amount from the home position) of the photosensitive element 20 on the basis of the image forming condition information table depicted in FIG. 16. Thus, processing is performed for cancelling the variation in the developing electric field intensity due to the variation in the developing gap caused by the deflection of the photosensitive element 20 and the developing sleeve 65 and the errors in the circumferential direction of latent image writing sensitivity of the photosensitive element 20 with the variation in the laser emission power.

As described above, when a print job is not being carried out, when the process unit or the developing device 61 is replaced and at least one of the first deflection information table, the second deflection information table, and the writing sensitivity information table is newly input, the main control section 500 updates data in the RAM 504 to be the same as input data. The gap variation information table is updated on the basis of data after update, and the image forming condition information table is then updated on the basis of the gap variation information table after update and the writing sensitivity information table.

Next, description will be provided as to the operation during a print job after the image forming condition information table has been updated.

In copying an original document by using this copying machine, first, the original document is set on a platen 30 of the automatic document feeder 400. The automatic document feeder 400 is opened, the original document is set on the contact glass 31 of the scanner 300, and the automatic document feeder 400 is closed to press the document. Thereafter, if the user depresses a start switch (not shown), when the document has been set in the automatic document feeder 400, the document is conveyed onto the contact glass 31. Then, the scanner 300 is driven and the first traveling member 33 and the second traveling member 34 start to travel. Thus, light from the first traveling member 33 is reflected by the document on the contact glass 31, and reflected light is reflected by a mirror of the second traveling member 34 and guided to the reading sensor 36 through the imaging lens 35. In this way, image information of the document is read.

If the user depresses the start switch, a driving motor (not shown) is driven and one of the support rollers 14, 15, and 16 is driven to rotate, such that the intermediate transfer belt 10 is driven to rotate. Simultaneously, in each of the image forming units 18Y, 18C, 18M, and 18K, the photosensitive element 20 and the developing sleeve 65 are set at the home positions, and the photosensitive element 20 and the developing sleeve 65 are driven to rotate.

FIG. 17 is an explanatory view depicting the positional relationship between the rotation position of each of the photosensitive element 20 and the developing sleeve 65 and a laser writing position 617 in one of the four image forming units 18Y, 18C, 18M, and 18K.

In FIG. 17, the distance from the photosensitive element deflection amount measurement point C in the developing area to the laser writing position 617 is denoted by L [m]. Here, if the time the photosensitive element deflection amount measurement point C reaches the laser writing position 617 is T [s], the following expression (8) is established.

$$T=L/(\omega 2\times R2) \quad (8)$$

After the time T [s] obtained by the above-described expression (8) has elapsed since the photosensitive element 20 has started to be driven to rotate, the laser writing device 21 irradiates the photosensitive element 20 of each image forming unit 18 with the writing light based on the image information read by the reading sensor 36 of the scanner 300 while varying the laser emission power in a time period described in the image forming condition information table of FIG. 16. Thus, at least each of the photosensitive element deflection amount measurement points is irradiated with the writing light at the laser emission power $LDP^{}_k$ after correction such that the developing electric field intensity which is formed when the point reaches the developing area becomes constant. Thus, on the respective photosensitive elements 20, electrostatic latent images are formed to have a potential such that the developing electric field intensity is substantially constant. As a result, if the respective developing devices 61 visualize the electrostatic latent images, toner images of yellow, cyan, magenta, and black with no irregularity in density are respectively formed on the photosensitive elements 20**.

The toner images of the respective colors formed in such a manner are primarily transferred to be sequentially superimposed on the intermediate transfer belt 10 by the primary transfer devices 62Y, 62C, 62M, and 62K. Thus, a composite toner image with the toner images of the respective colors superimposed is formed on the intermediate transfer belt 10. Transfer residual toner on the intermediate transfer belt 10 after secondary transfer is removed by the belt cleaning device 17. If the user depresses the start switch, the paper feeding roller 42 of the feeding device 200 according to the transfer sheet 5 selected by the user rotates and the transfer sheets 5 are fed from one of the paper cassettes 44. The fed transfer sheets 5 are separated by the separating roller 45 one by one, placed into the feed path 46, and conveyed to the conveying path 48 in the print section 100 by the carriage roller 47. The transfer sheet 5 conveyed in such a manner hits the registration roller 49*b* and stopped. The registration roller 49*b* starts to rotate at the timing at which the composite toner image formed on the intermediate transfer belt 10 is conveyed to the second transfer section facing the secondary transfer roller 24. The transfer sheet 5 fed by the registration roller 49*b* is fed between the intermediate transfer belt 10 and the secondary transfer roller 24, and the composite toner image on the intermediate transfer belt 10 is secondarily transferred to the transfer sheet 5 by the secondary transfer roller 24. Thereafter, the transfer sheet 5 is conveyed to the fixing device 25 in a state of being absorbed by the secondary transfer roller 24, and the fixing device 25 applies heat and pressure to perform processing for fixing the toner image. The transfer sheet 5 having passed through the fixing device 25 is discharged and stacked into the discharge tray 7 by the discharging roller 56. When image formation is also carried out on the rear surface of the surface with the toner image fixed, the conveying direction of the transfer sheet 5 having passed through the fixing device 25 is switched by the switching claw 55 and fed into the sheet reversing device 93. The transfer sheet 5 is reversed and again guided to the secondary transfer roller 24.

Next, a modification of the copying machine of the present embodiment will be described. Unless particularly described hereinafter, the configuration of a copying machine of the modification is the same as in the above-described embodiment.

In the copying machine of the modification, the IC of the process unit of each color stores only the first deflection information table, but does not store the writing sensitivity information table. Thus, when the process unit is replaced, only the first deflection information table is loaded on the main control section 500 as information of a new photosensitive element.

If it is detected that the processing unit is replaced, the main control section 500 performs processing for newly constructing the writing sensitivity information table for the photosensitive element of the process unit and storing the writing sensitivity information table in the RAM 504. Specifically, the linear approximate equation depicted in FIG. 9 is obtained for each measurement No. in the writing sensitivity information table depicted in FIG. 18 (a plurality of places in the circumferential direction of the photosensitive element). For example, for the place of the measurement No. 1, first, exposure is carried out with a predetermined first laser emission power at the timing at which the place is moved to a position to be irradiated with laser, and the potential of the exposed portion is detected by the potential sensor. Next, the photosensitive element rotates about once, exposure is carried out with a predetermined second laser emission power at the timing at which the place is moved again to the laser irradiation position, and the potential of the exposed portion is detected. Subsequently, the same processing is repeated while sequentially switching the laser emission power. Then, the linear approximate equation ($y=a_k x+b_k$) is obtained on the basis of the detection result of each exposed portion potential and each laser emission power. Similarly, the linear approximate equation is obtained at the place of each of the measurement Nos. 2 to $A_{n2}$, and the writing sensitivity information table depicted in FIG. 18 is updated on the basis of the results.

After the writing sensitivity information table is updated in such a manner, similarly to the copying machine of the embodiment, the image forming condition information table is updated.

As described above, the copying machine of this embodiment is the image forming apparatus which includes: the photosensitive elements 20Y, 20C, 20M, and 20K with the rotating surface serving as a latent image carrier; the laser writing device 21 serving as a latent image writing unit to change the surface potential of each of the photosensitive elements 20Y, 20C, 20M, and 20K, thereby forming an electrostatic latent image on the photosensitive element; and the developing device 61 serving as a developing unit to carry out development such that the surface of the developing sleeve 65 with the rotating surface serving as a developer carrier faces the surface of each of the photosensitive elements 20Y, 20C, 20M, and 20K, and toner on the developing sleeve 65 is stuck to the electrostatic latent image by the developing electric field between the electrostatic latent image on the photosensitive element and the surface of the developing sleeve 65. In the image forming apparatus, the toner images on the photosensitive elements 20Y, 20C, 20M, and 20K obtained by development are finally transferred to the transfer sheet 5 serving as a recording member to form an image on the transfer sheet 5. The RAM 504 of the main control section 500 has the storage area serving as an deflection amount measurement information storage unit to store photosensitive element deflection amount measurement information and sleeve deflection amount measurement information obtained by measuring the deflection amount of the outer circumference of each of the photosensitive element and the developing sleeve in the developing area, in which the photosensitive elements 20Y, 20C, 20M, and 20K and the developing sleeve 65 face each other, at two or more points of each of the photosensitive element and the developing sleeve, and the storage area serving as a home position gap information storage unit to store home position gap information obtained by measuring the developing gap when a deflection amount measurement point at which at least one deflection amount included in the photosensitive element deflection amount measurement information is measured and a deflection amount measurement point at which at least one deflection amount included in the sleeve deflection amount measurement information is measured face each other. The main control section 500 serving as a developing electric field intensity control unit obtains the respective developing electric field intensities from the photosensitive element deflection amount measurement information, the sleeve deflection amount measurement information, and the home position gap information stored in the RAM 504 when deflection amount measurement points corresponding to two or more deflection amounts included in the photosensitive element deflection amount measurement information and deflection amount measurement points corresponding to two or more deflection amounts included in the sleeve deflection amount measurement information face each other in the developing area, determines the content of developing electric field intensity control such that all the obtained developing electric field intensities fall within the allowable range of the target electric field intensity, and performs the developing electric field intensity control in accordance with the determined control content. Thus, even when the variation in the developing gap occurs due to the deflection of both the photosensitive element 20 and the developing sleeve 65, the changes in the developing electric field intensity can fall within the allowable range of the target electric filed intensity. In this embodiment, it is not necessary to form an unnecessary reference toner image so as to perform the developing electric field intensity control, thus there is no problem, such as an increase in downtime due to a reference toner image being formed or an increase in toner consumption.

With the developing electric field intensity control of the present embodiment, the laser writing device 21 is controlled to adjust the potential of the electrostatic latent image formed at each deflection amount measurement point on the surface of the photosensitive element such that all the developing electric field intensities fall within the allowable range of the reference intensity when the deflection amount measurement point exists in the developing area. The developing electric field intensity control may be performed by a method other than the control of the laser writing device 21. From the viewpoint of comparative ease of control and satisfactory accuracy, the control of the laser writing device 21 is preferably used.

In this embodiment, the main control section 500 serving as a control unit is configured such that, in updating the image forming condition information table, processing is performed for obtaining the relationship between the surface movement amount of the photosensitive element 20 and the developing electric field intensity in the developing gap on the basis of the developing potential between the electrostatic latent image on the surface of the photosensitive element 20 and the surface of the developing sleeve 61, the gap variation information table, and the writing sensitivity information table, and updating the image forming condition information table on the basis of the result. With this configuration, the image forming condition information table after update can be updated to have the content such that the variation in the developing electric field intensity due to the variation in the developing gap caused by the deflection of the photosensitive element 20 and the developing sleeve 65 and the errors in the circumferential direction of latent image writing sensitivity of the photosensitive element 20 can be cancelled with the variation in the laser emission power.

In the present embodiment, the image forming condition information table is information representing the relationship between the surface movement amount (measurement No.) of the photosensitive element 20 and the laser emission power which is the latent image writing intensity. Thus, the variation in the developing electric field intensity due to the variation in the developing gap or the errors in the circumferential direction of latent image writing sensitivity can be cancelled out by changing the laser emission power in accordance with the surface movement amount of the photosensitive element 20.

In the present embodiment, the potential sensor 120 serving as a surface potential detection unit to detect the surface potential of the photosensitive element 20 is provided. Simultaneously, the main control section 500 serving as a control unit is configured such that, in updating the image forming condition information table, processing is performed for forming the electrostatic latent image on the photosensitive element 20 at each power of the stepwise varying laser emission power, causing the potential sensor 120 to detect the potential of the electrostatic latent image, obtaining the linear approximate equation (y=ax+b) representing the relationship between the potential of the electrostatic latent image and the laser emission power on the basis of the detection result, and updating the image forming condition information table on the basis of the relationship, the gap variation information table, and the writing sensitivity information table. Thus, even when the developing electric field intensity control under the control of the laser writing device 21 and the potential set value adjustment control are used together, the developing electric field intensity can stably fall within the allowable range of the target electric field intensity.

In the present embodiment, both the photosensitive element deflection amount measurement information and the home position gap information are obtained from the deflection amount measured at the point on the photosensitive element surface passing through the detection area of the potential sensor 120. Thus, the developing electric field intensity at each measurement point can be more accurately obtained, and the developing electric field intensity can more accurately fall within the allowable range of the target electric field intensity.

In the present embodiment, the control of the laser writing device 21 conducted by the developing electric field intensity control is performed to control the exposure intensity of the laser writing device 21 such that the potential of the electrostatic latent image formed at each of the deflection amount measurement points on the photosensitive element surface corresponding to all the developing electric field intensities becomes the potential so as to fall all the developing electric field intensities within the allowable range of the target electric field intensity from the relationship (the linear approximate equation y=ax+b) obtained through the potential set value adjustment control. In this way, the use of the relationship obtained through the potential set value adjustment control enables efficient and quick processing.

In this embodiment, the potential sensor 120 serving as a surface potential detection unit and the optical sensor 110 serving as a stuck toner amount detection unit are provided. Simultaneously, the main control section is configured such that processing is performed for specifying the developing potential for obtaining the target stuck toner amount on the basis of the detection results of the sensors and updating the set value of the developing potential during a print job to the same value as the specification result. With this configuration, even when the value of the developing potential for obtaining the target image density is changed depending on the environmental variation or the like, the value is specified and the developing potential is used during a print job, such that the target image density can be obtained regardless of the environmental variation.

In the present embodiment, when the developing potential is updated, the main control section 500 is configured such that processing is performed for updating the image forming condition information table on the basis of the developing potential after update, the gap variation information table, and the writing sensitivity information table prior to subsequently starting a print job. With this configuration, when the developing potential is updated and the image forming condition information table is unreasonable, the image forming condition information table is updated on the basis of the developing potential after update. Thus, the content of the image forming condition information table can be appropriate for the developing potential after update.

In the present embodiment, the photosensitive element 20 and the memory serving as a storage unit which stores the first deflection information table and the writing sensitivity information table are held by a common holding member (casing) as a process unit serving as a single latent image carrying unit and detachably mounted in the copying machine main body. The developing sleeve 65 and the memory serving as a storage unit which stores the second deflection information table are held by a common holding member (casing) as the developing device 61 serving as a single developing unit and detachably mounted in the copying machine main body. The information input unit is configured such that, as the process unit is mounted in the copying machine main body, the first deflection information table and the writing sensitivity information table stored in the memory of the process unit are input to the main control section 500, and as the developing device 61 is mounted in the copying machine main body, the second deflection information table stored in the memory of the developing device 61 is input to the main control section 500. With this configuration, as the photosensitive element 20 is replaced, the first deflection information table and the writing sensitivity information table corresponding to the new photosensitive element 20 after replacement can be automatically input to the main control section 500. As the developing sleeve 65 is replaced, the second deflection information table corresponding to the new developing sleeve 65 after replacement can be input to the main control section 500.

Although in the present embodiment, an example has been described where the developing electric field intensity control and the potential set value adjustment control are used together, the developing electric field intensity control may be performed even in a configuration in which the potential set value adjustment control is not performed.

Although in the present embodiment, the intermediate transfer type configuration has been described where the toner image on the photosensitive element 20 is transferred to the transfer sheet 5 through the intermediate transfer belt 10, the invention is not limited to this configuration. For example, the following configuration may be used. A sheet conveying belt is provided at a position facing a photosensitive element, and a toner image on the photosensitive element is transferred directly to a transfer sheet fed while being held on the surface of the sheet conveying belt. Even in this type, a reference patch is transferred to the surface of the sheet conveying belt, not to the transfer sheet held on the surface of the sheet conveying belt, such that the reference patch on the surface of the sheet conveying belt can be detected by an optical sensor.

Although a color type copying machine has been described in which a multi-color toner image is formed by superimposing transfer, the invention may be applied to a monochrome type image forming apparatus which forms only a monochrome toner image.

According to the aspects of the invention, during the image forming operation, the image forming conditions such as the developing bias, the latent image writing intensity, and the like are changed to values depending on the surface movement amount of the latent image carrier or the developer carrier on the basis of the image forming condition information. Thus, the deviation in the opposing direction caused by changing of the image forming condition is superimposed on the deviation from the reference value of the developing electric field intensity attributable to the variation in the developing gap caused by the deflection of the latent image carrier and the developer carrier or errors in the circumferential direction of latent image writing sensitivity of the latent image carrier. With this superimposition, the developing electric field intensity is made to come close to the reference value to stabilize the developing electric field intensity. This reduces irregularity in image density. With this configuration, it is possible to reduce irregularity in image density attributable to the variation in the developing gap or errors of latent image writing sensitivity of the latent image carrier without forming a test image for detecting irregularity in image density.

With the specific features of the first aspect, if at least one of the latent image carrier and the developer carrier is replaced, new deflection information (first deflection information or second deflection information) or writing sensitivity information corresponding to the latent image carrier or the developer carrier after replacement is input, the image forming condition for generating the deviation in the opposing direction is calculated on the basis of the input information to update the image forming condition information, making it possible to appropriately superimpose the deviation in the opposing direction caused by changing of the image forming condition on the deviation from the reference value of the developing electric field intensity due to the variation in the developing gap after replacement or errors in the circumferential direction of latent image writing sensitivity. Therefore, even when the latent image carrier or the developer carrier is replaced, it is possible to reduce irregularity in image density, without forming a test image for detecting irregularity in image density.

With the specific features of the second aspect, if the first deflection information is input to the information input unit, that is, if the latent image carrier is replaced, the relationship between the latent image potential and the latent image writing intensity is obtained on the basis of the detection result of the potential of a latent image written under the condition of a plurality of latent image writing intensities at a plurality of places in the circumferential direction of the new latent image carrier, and the writing sensitivity information of the latent image carrier is constructed on the basis of the result. If at least one of the latent image carrier and the developer carrier is replaced and new deflection information (first deflection information or second deflection information) corresponding to the latent image carrier or the developer carrier after replacement is input, the image forming condition for generating the deviation in the opposing direction is calculated on the basis of the input information to update the image forming condition information, making it possible to appropriately superimpose the deviation in the opposing direction caused by changing the image forming condition on the deviation from the reference value of the developing electric field intensity due to the variation in the developing gap or errors in the circumferential direction of latent image writing sensitivity. Therefore, even when the latent image carrier or the developer carrier is replaced, it is possible to reduce irregularity in image density without forming a test image for detecting irregularity in image density.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus configured to form an image using an image forming unit and a control unit, the image forming apparatus comprising:

the image forming unit including a latent image carrier carrying a latent image on the rotating surface thereof, a latent image writing unit writing an electrostatic latent image on the surface of the latent image carrier, and a developer carrier developing the electrostatic latent image with a developer carried on the rotating surface thereof while forming a developing electric field between the electrostatic latent image on the latent image carrier and the surface of the developer carrier in a developing area where the latent image carrier and the surface of the developer carrier are opposite each other with a predetermined developing gap therebetween;

the control unit performing processing of controlling driving of the image forming unit or processing of varying an image forming condition of the image forming unit;

an information storage unit which stores first deflection information, second deflection information, writing sensitivity information, and image forming condition information, the first deflection information representing the relationship between the surface movement amount of the latent image carrier and the deflection amount in a direction of variation in the developing gap, at a place within the developing gap from the circumferential surface of the latent image carrier, the second deflection information representing the relationship between the surface movement amount of the developer carrier and the deflection amount in a direction of variation in the developing gap at a place within the developing gap from the circumferential surface of the developer carrier, the writing sensitivity information representing the relationship between the surface movement amount of the latent image carrier and latent image writing sensitivity, and the image forming condition information representing the relationship between the surface movement amount of at least one of the latent image carrier and the developer carrier and an image forming condition for generating deviation in an opposing direction to deviation from a reference value attributable to the deflection of the latent image carrier, the deflection of the developer carrier, and errors in the circumferential direction of latent image writing sensitivity of the latent image carrier in a developing electric field intensity; and an information input unit which inputs the first deflection information, the second deflection information, and the writing sensitivity information, wherein the control unit is configured such that, during an image forming operation, processing is performed for changing the image forming condition to a value based on the surface movement amount of one of the latent image carrier and the developer carrier on the basis of the image forming condition information; and when the image forming operation is not carried out, if at least one of the first deflection information, the second deflection information, and the writing sensitivity information is input by the information input unit, processing is performed for calculating the image forming condition for generating the deviation in the opposing direction on the basis of the input information to update the image forming condition information.

2. The image forming apparatus according to claim 1, wherein the control unit is configured such that, in updating the image forming condition information, processing is performed for obtaining the relationship between the surface movement amount of at least one of the latent image carrier and the developer carrier and the intensity of the developing electric field between the electrostatic latent image and the developer carrier in the developing gap on the basis of a developing potential which is the potential difference between the electrostatic latent image on the surface of the latent image carrier and the surface of the developer carrier, the first deflection information, and the second deflection information, and updating the image forming condition information on the basis of the result.

3. The image forming apparatus according to claim 2, wherein the image forming condition information is information representing the relationship between the surface movement amount and a latent image writing intensity by the latent image writing unit, which is the image forming condition.

4. The image forming apparatus according to claim 2, further comprising:

a surface potential detection unit which detects the surface potential of the latent image carrier; and a stuck toner amount detection unit which detects a stuck toner amount per unit area for a predetermined reference toner image developed on the surface of the latent image carrier, wherein the control unit is configured such that processing is performed for specifying a developing potential to obtain a target stuck toner amount on the basis of the detection result of the surface potential detection unit and the detection result of the stuck toner amount detection unit and updating the set value of the developing potential during the image forming operation to the same value as the specification result.

5. The image forming apparatus according to claim 4, wherein the control unit is configured such that, in updating the developing potential, prior to starting the image forming operation subsequently, processing is performed for updating the image forming condition information, the developing potential after updating, the first deflection information, the second deflection information, and the writing sensitivity information.

6. The image forming apparatus according to claim 1, wherein the latent image carrier and a storage unit which stores the first deflection information and the writing sensitivity information are held as a single latent image carrying unit by a common holding member to be attached and detached to and from an image forming apparatus main body, the developer carrier and a storage unit which stores the second deflection information are held as a single developing unit by a common holding member to be attached and detached to and from the image forming apparatus main body, and the information input unit is configured such that, as the latent image carrying unit is mounted in the image forming apparatus main body, the first deflection information and the writing sensitivity information stored in the storage unit of the latent image carrying unit or only the first deflection information is input to the control unit, and as the developing is mounted in the image forming apparatus main body, the second deflection information stored in the storage unit of the developing unit is input to the control unit.

7. The image forming apparatus according to claim 3, wherein all the first deflection information, the second deflection information, and the writing sensitivity information are information of the same area as a potential detection area by the surface potential detection unit in a direction perpendicular to a surface movement direction in surface of the latent image carrier or the developer carrier.

8. The image forming apparatus according to claim 4, wherein all the first deflection information, the second deflection information, and the writing sensitivity information are information of the same area as a potential detection area by the surface potential detection unit in a direction perpendicular to a surface movement direction in surface of the latent image carrier or the developer carrier.

9. The image forming apparatus according to claim 3, wherein the control unit is configured such that processing is performed for updating the image forming condition information on the basis of the result of obtaining the relationship between the surface movement amount and the latent image writing intensity for obtaining a latent image potential such that developing electric field intensity falls within an allowable range from a predetermined reference intensity.

10. An image forming apparatus for forming an image using an image forming unit and a control unit, the image forming apparatus comprising:

the image forming unit including a latent image carrier carrying a latent image on the rotating surface thereof, a latent image writing unit writing an electrostatic latent image on the surface of the latent image carrier, and a developer carrier developing the electrostatic latent image with a developer carried on the rotating surface thereof while forming a developing electric field between the electrostatic latent image on the latent image carrier and the surface of the developer carrier in a developing area where the latent image carrier and the surface of the developer carrier are opposite each other with a predetermined developing gap therebetween;

the control unit performing processing of controlling driving of the image forming unit or processing of varying an image forming condition of the image forming unit;

an information storage unit which stores first deflection information, second deflection information, writing sensitivity information, and image forming condition information, the first deflection information representing the relationship between the surface movement amount of the latent image carrier and the deflection amount in a direction of variation in the developing gap, at a place within the developing gap from the circumferential surface of the latent image carrier, the second deflection information representing the relationship between the surface movement amount of the developer carrier and the deflection amount in a direction of variation in the developing gap at a place within the developing gap from the circumferential surface of the developer carrier, the writing sensitivity information representing the relationship between the surface movement amount of the latent image carrier and latent image writing sensitivity, and the image forming condition information representing the relationship between the surface movement amount of at least one of the latent image carrier and the developer carrier and an image forming condition for generating deviation in an opposing direction to deviation from a reference value attributable to the deflection of the latent image carrier, the deflection of the developer carrier, and errors in the circumferential direction of latent image writing sensitivity of the latent image carrier in a developing electric field intensity;

an information input unit which inputs the first deflection information and the second deflection information; and a surface potential detection unit which detects the surface potential of the latent image carrier, wherein the control unit is configured such that, during an image forming operation, processing is performed for changing the image forming condition to a value based on the surface movement amount of one of the latent image carrier and the developer carrier on the basis of the image forming condition information; and when the image forming operation is not carried out, if at least one of the first deflection information and the second deflection information is input by the information input unit, processing is performed for calculating the image forming condition for generating the deflection in the opposing direction on the input information to update the image forming condition information; and if the first deflection information is input by the information input unit, processing is performed for forming an electrostatic latent image at each latent image writing intensity of the stepwise varying latent image writing intensities, obtaining the relationship between the potential of the electrostatic latent image and the latent image writing intensity on the basis of the sequential detection result of the potential of the electrostatic latent image by the surface potential detection unit at each of a plurality of places in the circumferential direction of the latent image carrier, and constructing the writing sensitivity information on the basis of the relationship.

11. The image forming apparatus according to claim 10, wherein the control unit is configured such that, in updating the image forming condition information, processing is performed for obtaining the relationship between the surface movement amount of at least one of the latent image carrier and the developer carrier and the intensity of the developing electric field between the electrostatic latent image and the developer carrier in the developing gap on the basis of a developing potential which is the potential difference between the electrostatic latent image on the surface of the latent image carrier and the surface of the developer carrier, the first deflection information, and the second deflection information, and updating the image forming condition information on the basis of the result.

12. The image forming apparatus according to claim 11, wherein the image forming condition information is information representing the relationship between the surface movement amount and a latent image writing intensity by the latent image writing unit, which is the image forming condition.

13. The image forming apparatus according to claim 11, further comprising:

a surface potential detection unit which detects the surface potential of the latent image carrier; and a stuck toner amount detection unit which detects a stuck toner amount per unit area for a predetermined reference toner image developed on the surface of the latent image carrier, wherein the control unit is configured such that processing is performed for specifying a developing potential to obtain a target stuck toner amount on the basis of the detection result of the surface potential detection unit and the detection result of the stuck toner amount detection unit and updating the set value of the developing potential during the image forming operation to the same value as the specification result.

14. The image forming apparatus according to claim 13, wherein the control unit is configured such that, in updating the developing potential, prior to starting the image forming operation subsequently, processing is performed for updating the image forming condition information, the developing potential after updating, the first deflection information, the second deflection information, and the writing sensitivity information.

15. The image forming apparatus according to claim 10, wherein the latent image carrier and a storage unit which stores the first deflection information and the writing sensitivity information are held as a single latent image carrying unit by a common holding member to be attached and detached to and from an image forming apparatus main body, the developer carrier and a storage unit which stores the second deflection information are held as a single developing unit by a common holding member to be attached and detached to and from the image forming apparatus main body, and the information input unit is configured such that, as the latent image carrying unit is mounted in the image forming apparatus main body, the first deflection information and the writing sensitivity information stored in the storage unit of the latent image carrying unit or only the first deflection information is input to the control unit, and as the developing is mounted in the image forming apparatus main body, the second deflection information stored in the storage unit of the developing unit is input to the control unit.

16. The image forming apparatus according to claim 12, wherein all the first deflection information, the second deflection information, and the writing sensitivity information are information of the same area as a potential detection area by the surface potential detection unit in a direction perpendicular to a surface movement direction in surface of the latent image carrier or the developer carrier.

17. The image forming apparatus according to claim 13, wherein all the first deflection information, the second deflection information, and the writing sensitivity information are information of the same area as a potential detection area by the surface potential detection unit in a direction perpendicular to a surface movement direction in surface of the latent image carrier or the developer carrier.

18. The image forming apparatus according to claim 12, wherein the control unit is configured such that processing is performed for updating the image forming condition information on the basis of the result of obtaining the relationship between the surface movement amount and the latent image writing intensity for obtaining a latent image potential such that developing electric field intensity falls within an allowable range from a predetermined reference intensity.

* * * * *